US008384623B2

(12) United States Patent
Tomioka et al.

(10) Patent No.: US 8,384,623 B2
(45) **Date of Patent: *Feb. 26, 2013**

(54) PLASMA DISPLAY DEVICE AND PLASMA DISPLAY PANEL DRIVE METHOD

(75) Inventors: Naoyuki Tomioka, Osaka (JP); Naoki Noguchi, Osaka (JP)

(73) Assignee: Panasonic Corporation, Osaka (JP)

( * ) Notice: Subject to any disclaimer, the term of this patent is extended or adjusted under 35 U.S.C. 154(b) by 317 days.

This patent is subject to a terminal disclaimer.

(21) Appl. No.: 12/743,292

(22) PCT Filed: Nov. 12, 2008

(86) PCT No.: PCT/JP2008/003274

§ 371 (c)(1),
(2), (4) Date: May 17, 2010

(87) PCT Pub. No.: WO2009/063622

PCT Pub. Date: May 22, 2009

(65) Prior Publication Data

US 2010/0253712 A1 Oct. 7, 2010

(30) Foreign Application Priority Data

Nov. 15, 2007 (JP) ..... 2007-296518

(51) Int. Cl.
*G09G 3/28* (2006.01)
*G09G 5/10* (2006.01)
*G09G 3/10* (2006.01)

(52) U.S. Cl. ..... 345/60; 345/690; 315/169.4

(58) Field of Classification Search ..... 345/60–72, 345/690; 315/169.4

See application file for complete search history.

(56) References Cited

U.S. PATENT DOCUMENTS 4,866,349 A 9/1989 Weber et al.
6,426,732 B1 7/2002 Makino
7,576,711 B2 * 8/2009 An ..... 345/60
7,619,589 B2 * 11/2009 Chae et al. ..... 345/67

(Continued)

FOREIGN PATENT DOCUMENTS

JP 7-109542 11/1995
JP 11-065514 3/1999

(Continued)

OTHER PUBLICATIONS

International Search Report for International Application No. PCT/JP2008/003274, Feb. 10, 2009, Panasonic Corporation.

*Primary Examiner* — Bipin Shalwala
*Assistant Examiner* — Ilana Spar
(74) *Attorney, Agent, or Firm* — RatnerPrestia

(57) ABSTRACT

Sustain discharge is stably caused while power consumption is reduced, and image display quality is improved. A plasma display device has a plasma display panel, an electric power recovering circuit for raising or falling a sustain pulse by resonating an inductor and the inter-electrode capacity of a display electrode pair, and a sustain pulse generating circuit for alternately applying, to the display electrode pair, as many sustain pulses as the number corresponding to the luminance weight in the sustain period of a plurality of subfields that are disposed in one field and have initializing, address, and sustain periods. The sustain pulse generating circuit switches and generates at least three kinds of sustain pulses including a first sustain pulse serving as a reference, a second sustain pulse that rises more gently than the first sustain pulse, and a third sustain pulse that rises more steeply than the first sustain pulse.

8 Claims, 18 Drawing Sheets

U.S. PATENT DOCUMENTS

| | | | | |
|---|---|---|---|---|
| 2006/0244684 | A1* | 11/2006 | Kong et al. | 345/60 |
| 2006/0273992 | A1* | 12/2006 | Kim et al. | 345/68 |
| 2007/0097031 | A1 | 5/2007 | Mima et al. | |
| 2010/0265270 | A1* | 10/2010 | Shen et al. | 345/690 |

FOREIGN PATENT DOCUMENTS

| | | | | |
|---|---|---|---|---|
| JP | 2000-276105 | A | | 10/2000 |
| JP | 2000-276105 | A | | 10/2000 |
| JP | 2003-323150 | A | | 11/2003 |
| JP | 2003323150 | A | * | 11/2003 |
| JP | 2005-338120 | A | | 12/2005 |
| JP | 2006-146035 | | | 6/2006 |
| JP | 2006-349805 | A | | 12/2006 |
| JP | 2006349805 | A | * | 12/2006 |
| JP | 2007-033736 | A | | 2/2007 |
| JP | 2007-033736 | A | | 2/2007 |
| KR | 10-2010-7010534 | | | 5/2011 |

* cited by examiner

FIG. 19

| All-cell light-emitting rate / Maximum value of partial light-emitting rates | Smaller than light-emitting rate threshold | Light-emitting rate threshold or larger |
|---|---|---|
| Smaller than maximum value threshold | Second sustain pulse 1/3<br>Third sustain pulse 1/6 | Second sustain pulse 1/4<br>Third sustain pulse 1/5 |
| Maximum value threshold or larger | Second sustain pulse 1/5<br>Third sustain pulse 1/4 | Second sustain pulse 1/6<br>Third sustain pulse 1/3 |

PLASMA DISPLAY DEVICE AND PLASMA DISPLAY PANEL DRIVE METHOD

THIS APPLICATION IS A U.S. NATIONAL PHASE APPLICATION OF PCT INTERNATIONAL APPLICATION PCT/JP2008/003274.

TECHNICAL FIELD

The present invention relates to a plasma display device used in a wall-hanging television (TV) or a large monitor, and a driving method for a plasma display panel.

BACKGROUND ART

A typical alternating-current surface discharge type panel used as a plasma display panel (hereinafter referred to as "panel") has many discharge cells between a front plate and a back plate that are faced to each other. The front plate has the following elements:

- a plurality of display electrode pairs disposed in parallel on a front glass substrate; and
- a dielectric layer and a protective layer for covering the display electrode pairs.

Here, each display electrode pair is formed of a pair of scan electrode and sustain electrode. The back plate has the following elements:

- a plurality of data electrodes disposed in parallel on a back glass substrate;
- a dielectric layer for covering the data electrodes;
- a plurality of barrier ribs disposed on the dielectric layer in parallel with the data electrodes; and
- phosphor layers disposed on the surface of the dielectric layer and on side surfaces of the barrier ribs.

The front plate and back plate are faced to each other so that the display electrode pairs and the data electrodes three-dimensionally intersect, and are sealed. Discharge gas containing xenon with a partial pressure of 5%, for example, is filled into a discharge space in the sealed product. Discharge cells are disposed in intersecting parts of the display electrode pairs and the data electrodes. In the panel having this structure, ultraviolet rays are emitted by gas discharge in each discharge cell. The ultraviolet rays excite respective phosphors of red (R), green (G), and blue (B) to emit light, and thus provide color display.

A subfield method is generally used as a method of driving the panel. In this method, one field is divided into a plurality of subfields, and the subfields at which light is emitted are combined, thereby performing gradation display.

Each subfield has an initializing period, an address period, and a sustain period. In the initializing period, initializing discharge is caused, a wall charge required for a subsequent address operation is formed on each electrode, and a priming particle (an excitation particle for causing address discharge) for stably causing address discharge is generated.

In the address period, address pulse voltage is selectively applied to a discharge cell where display is to be performed to cause address discharge, thereby forming a wall charge (hereinafter, this operation is referred to as "address"). In the sustain period, sustain pulse voltage is alternately applied to the display electrode pairs formed of the scan electrodes and the sustain electrodes, sustain discharge is caused in the discharge cell having undergone address discharge, and a phosphor layer of the corresponding discharge cell is light-emitted, thereby displaying an image.

In this subfield method, the following operations are performed. In the initializing period of one of a plurality of subfields, the all-cell initializing operation of causing discharge in all discharge cells is performed. In the initializing period of other subfields, the selection initializing operation of selectively causing initializing discharge in the discharge cell having undergone sustain discharge is performed. Thus, light emission that is not related to the gradation display is minimized, and the contrast ratio can be improved.

As a circuit for applying a sustain pulse to a display electrode pair, the so-called electric power recovering circuit capable of reducing power consumption is generally used (e.g. patent document 1). Patent document 1 discloses an electric power recovering circuit, focusing attention on a fact that each display electrode pair is a capacitive load having an inter-electrode capacity of the display electrode pair. The disclosed electric power recovering circuit LC(inductance-capacitance)-resonates an inductor and the inter-electrode capacity using a resonance circuit including the inductor as a component, recovers the electric power stored in the inter-electrode capacity in a capacitor for electric power recovery, and recycles the recovered electric power for driving the display electrode pair.

Recently, the screen size and definition of the panel have been further increased, and hence various studies of improving the luminous efficiency of the panel and improving the luminance have been performed. For example, a study of largely increasing the luminous efficiency by increasing the xenon partial pressure has been performed. When the xenon partial pressure is increased, however, variation in timing of causing discharge increases, the light emission intensity in each discharge cell varies, and the display luminance can become un-uniform. In order to improve the un-uniformity of the luminance, a driving method is disclosed in which the rising period is shortened once per a plurality of times in the sustain period, for example, a sustain pulse whose rising is steep is inserted, the timing of the sustain discharge is aligned, and the display luminance is uniformed (e.g. patent document 2).

A technology is disclosed where, in the sustain period, the switch timing from the electric power recovering circuit to a clamping circuit of a sustain pulse that belongs to a first group including the firstly applied sustain pulse is delayed comparing with sustain pulses that belong to the other groups, thereby suppressing the variation in light emission intensity in each discharge cell to improve the display quality (e.g. patent document 3).

Recently, the screen size and luminance of the panel have been increased, and hence power consumption of the panel is apt to increase. Recent increase in definition of the panel increases the number of electrodes to be driven, and hence further increases the power consumption. Therefore, the power consumption is desired to be further reduced.

Regarding a panel whose screen size and definition are increased, the load during driving of the panel increases, so that the discharge is apt to become unstable and hence it is further important to cause stable sustain discharge.

In the technology disclosed in patent document 2, for example, a sustain pulse having steep rising can suppress variation in light emission intensity in each discharge cell and cause stable sustain discharge. However, the recovery efficiency in the electric power recovering circuit decreases, and hence it is difficult to reduce the power consumption.

In the technology disclosed in patent document 3, a sustain pulse whose rising is moderated by delaying the switch timing from the electric power recovering circuit to the clamping circuit comparing with the sustain pulses that belong to the other groups can produce the following effects:

suppressing variation in light emission intensity in each discharge cell, and increasing the recovery efficiency in the electric power recovering circuit to reduce the power consumption.

However, the sustain pulse whose rising is moderated has a discharge intensity lower that that of the sustain pulse whose rising is steep, and hardly produces sufficient wall charge in the discharge cell. In the technology disclosed in patent document 3, disadvantageously, this sustain pulse continuously occurs and hence the sustain discharge hardly occurs.

[Patent document 1] Japanese Translation of PCT Publication No. H07-109542

[Patent document 2] Japanese Patent Unexamined Publication No. 2005-338120

[Patent document 3] Japanese Patent Unexamined Publication No. 2006-146035

SUMMARY OF THE INVENTION

The plasma display device of the present invention has the following elements:

a panel that is driven by a subfield method and has a plurality of discharge cells including a display electrode pair that is formed of a scan electrode and a sustain electrode;

an electric power recovering circuit for raising or falling a sustain pulse by resonating an inductor and the inter-electrode-capacity of the display electrode pair; and a clamping circuit for clamping the voltage of the sustain pulse on a predetermined voltage; and a sustain pulse generating circuit for alternately applying sustain pulses as many as the number corresponding to the luminance weight in the sustain period to display electrode pairs.

In the subfield method, a plurality of subfields having an initializing period, an address period, and a sustain period are disposed in one field, and the luminance weight is set for each subfield, and the gradation display is performed. The sustain pulse generating circuit generates at least three kinds of sustain pulses so that the second sustain pulse does not continue. The three kinds of sustain pulses include a first sustain pulse serving as a reference, a second sustain pulse whose rising is gentler than that of the first sustain pulse, and a third sustain pulse whose rising is steeper than that of the first sustain pulse.

Thus, even in the panel whose screen size, luminance, and definition are increased, sustain discharge can be stably caused while the power consumption is reduced, and the image display quality of the panel can be improved.

BRIEF DESCRIPTION OF DRAWINGS

FIG. 19 is a diagram showing an example of generation of each sustain pulse corresponding to the all-cell light-emitting rate and the maximum value of the partial light-emitting rates in accordance with the second exemplary embodiment.

REFERENCE MARKS IN THE DRAWINGS

Figure 1:
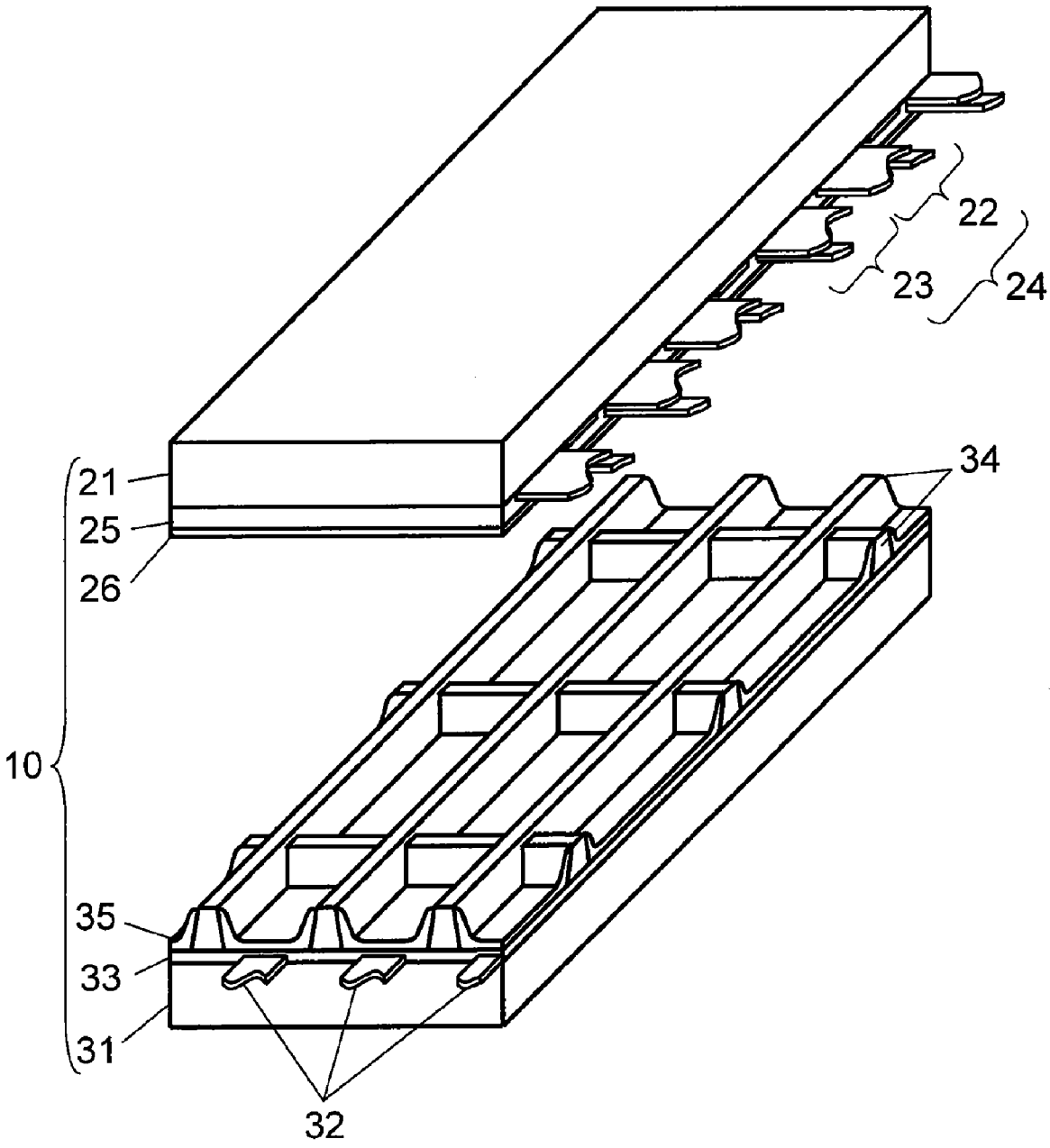
FIG. 1 is an exploded perspective view showing a structure of a panel in accordance with a first exemplary embodiment of the present invention.

1, 2 plasma display device
10 panel
21 front plate
22 scan electrode
23 sustain electrode
24 display electrode pair
25, 33 dielectric layer
26 protective layer
31 back plate
32 data electrode
34 barrier rib
35 phosphor layer
41 image signal processing circuit
42 data electrode driving circuit
43 scan electrode driving circuit
44 sustain electrode driving circuit
45 timing generating circuit
46 all-cell light-emitting rate detecting circuit
47 partial light-emitting rate detecting circuit
48 maximum value detecting circuit
50, 60 sustain pulse generating circuit
51, 61 electric power recovering circuit

52, 62 clamping circuit
Q11, Q12, Q13, Q14, Q21, Q22, Q23, Q24, Q26, Q27, Q28, Q29 switching element
C10, C20, C30 capacitor
L10, L20 inductor
D11, D12, D21, D22, D30 diode

DETAILED DESCRIPTION OF PREFERRED EMBODIMENTS

A plasma display device in accordance with an exemplary embodiment of the present invention will be described hereinafter with reference to the accompanying drawings.

First Exemplary Embodiment

FIG. 1 is an exploded perspective view showing a structure of panel 10 in accordance with the first exemplary embodiment of the present invention. A plurality of display electrode pairs 24 formed of scan electrodes 22 and sustain electrodes 23 are disposed on glass-made front plate 21. Dielectric layer 25 is formed so as to cover scan electrodes 22 and sustain electrodes 23, and protective layer 26 is formed on dielectric layer 25.

Protective layer 26 is actually used as a material of the panel in order to reduce the discharge start voltage in a discharge cell. Protective layer 26 is made of material that is mainly made of MgO and has a large secondary electron discharge coefficient and high durability when neon (Ne) and xenon (Xe) gases are filled.

A plurality of data electrodes 32 are formed on back plate 31, dielectric layer 33 is formed so as to cover data electrodes 32, and mesh barrier ribs 34 are formed on dielectric layer 33. Phosphor layers 35 for emitting lights of respective colors of red (R), green (G), and blue (B) are formed on the side surfaces of barrier ribs 34 and on dielectric layer 33.

Front plate 21 and back plate 31 are faced to each other so that display electrode pairs 24 cross data electrodes 32 with a micro discharge space sandwiched between them, and the outer peripheries of them are sealed by a sealing material such as glass frit. The discharge space is filled with mixed gas of neon and xenon as discharge gas. In the present embodiment, discharge gas where xenon partial pressure is set at about 10% is employed for improving luminous efficiency. The discharge space is partitioned into a plurality of sections by barrier ribs 34. Discharge cells are formed in the intersecting parts of display electrode pairs 24 and data electrodes 32. The discharge cells discharge and emit light to display an image.

The structure of panel 10 is not limited to the above-mentioned one, but may be a structure having striped barrier ribs, for example. The mixing ratio of the discharge gas is not limited to the above-mentioned value, but may be another mixing ratio.

Figure 2:
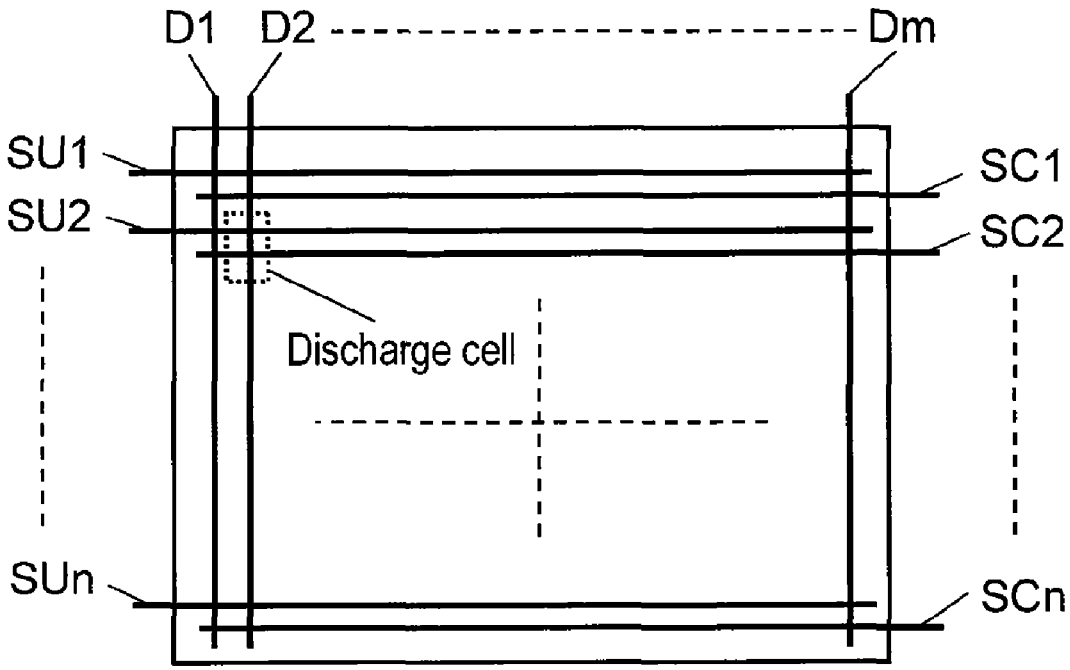
FIG. 2 is an electrode array diagram of the panel.

FIG. 2 is an electrode array diagram of panel 10 in accordance with the first exemplary embodiment' of the present invention. In panel 10, n scan electrode SC1 through scan electrode SCn (scan electrodes 22 in FIG. 1) and n sustain electrode SU1 through sustain electrode SUn (sustain electrodes 23 in FIG. 1) long in the column direction are arranged, and m data electrode D1 through data electrode Dm (data electrodes 32 in FIG. 1) long in the row direction are arranged. Each discharge cell is formed in the intersecting part of a pair of scan electrode SCi (i=1 through n) and sustain electrode SUi and one data electrode Dj (j=1 through m), the number of formed discharge cells in the discharge space is m×n. The region where m×n discharge cells are formed becomes a display region of panel 10.

Next, a driving voltage waveform and its operation for driving panel 10 are described. The plasma display device of the present embodiment performs gradation display by a subfield method. In this method, one field is divided into a plurality of subfields, and emission and non-emission of light of each display cell are controlled in each subfield. Each subfield has an initializing period, an address period, and a sustain period.

In the initializing period in each subfield, initializing discharge is caused to produce a wall charge required for a subsequent address discharge on each electrode. The initializing operation has a function of generating a priming particle (an excitation particle as a detonating agent for discharge) for reducing the discharge delay and stably causing the address discharge. The initializing operation at this time includes an all-cell initializing operation of causing initializing discharge in all discharge cells, and a selection initializing operation of selectively causing initializing discharge only in a discharge cell that has undergone sustain discharge in the adjacently previous subfield.

In the address period, address discharge is selectively caused in a discharge cell to emit light in a subsequent sustain period, thereby producing a wall charge. In the sustain period, as many sustain pulses as the number proportional to luminance weight are alternately applied to display electrode pairs 24, and sustain discharge is caused in the discharge cell having undergone address discharge, thereby emitting light. The proportionality constant at this time is called "luminance magnification".

In the present embodiment, one field is formed of 10 subfields (first SF, second SF, . . . , 10th SF), and respective subfields have luminance weights of 1, 2, 3, 6, 11, 18, 30, 44, 60 and 80, for example. The all-cell initializing operation is performed in the initializing period of the first SF, and the selection initializing operation is performed in the initializing period of each of the second SF through 10th SF. Thus, the light emission that is not related to the image display is only light emission caused by discharge in the all-cell initializing operation in the first SF. Therefore, luminance of black level, which is the luminance in a black display region where sustain discharge is not caused, is determined only by weak light emission in the all-cell initializing operation, and image display of sharp contrast is allowed. In the sustain period of each subfield, as many sustain pulses as the number derived by multiplying the luminance weight of each subfield by a predetermined luminance magnification are applied to respective display electrode pairs 24.

In the present embodiment, the number of subfields and luminance weight of each subfield are not limited to the above-mentioned values. The subfield structure may be changed based on an image signal or the like.

In the present embodiment, the length of the period (hereinafter referred to as "rising period") when an after-mentioned electric power recovering circuit is operated in order to raise a sustain pulse is changed to generate the sustain pulse. Specifically, in the sustain period, the following three kinds of sustain pulses are switched and generated so that the second sustain pulse does not continue. The three kinds of sustain pulses include a first sustain pulse serving as a reference, a second sustain pulse whose rising is moderated by making the "rising period" longer than that of the first sustain pulse, and a third sustain pulse whose rising is sharpened by making the "rising period" shorter than that of the first sustain pulse. Thus, the sustain discharge is stabilized to uniform the display luminance of each discharge cell while the power consumption of panel 10 is reduced, thereby improving the image display quality of panel 10.

Next, the outline of a driving voltage waveform and the configuration of the driving circuit are firstly described, then the operation in the sustain period is described in detail.

Figure 3:
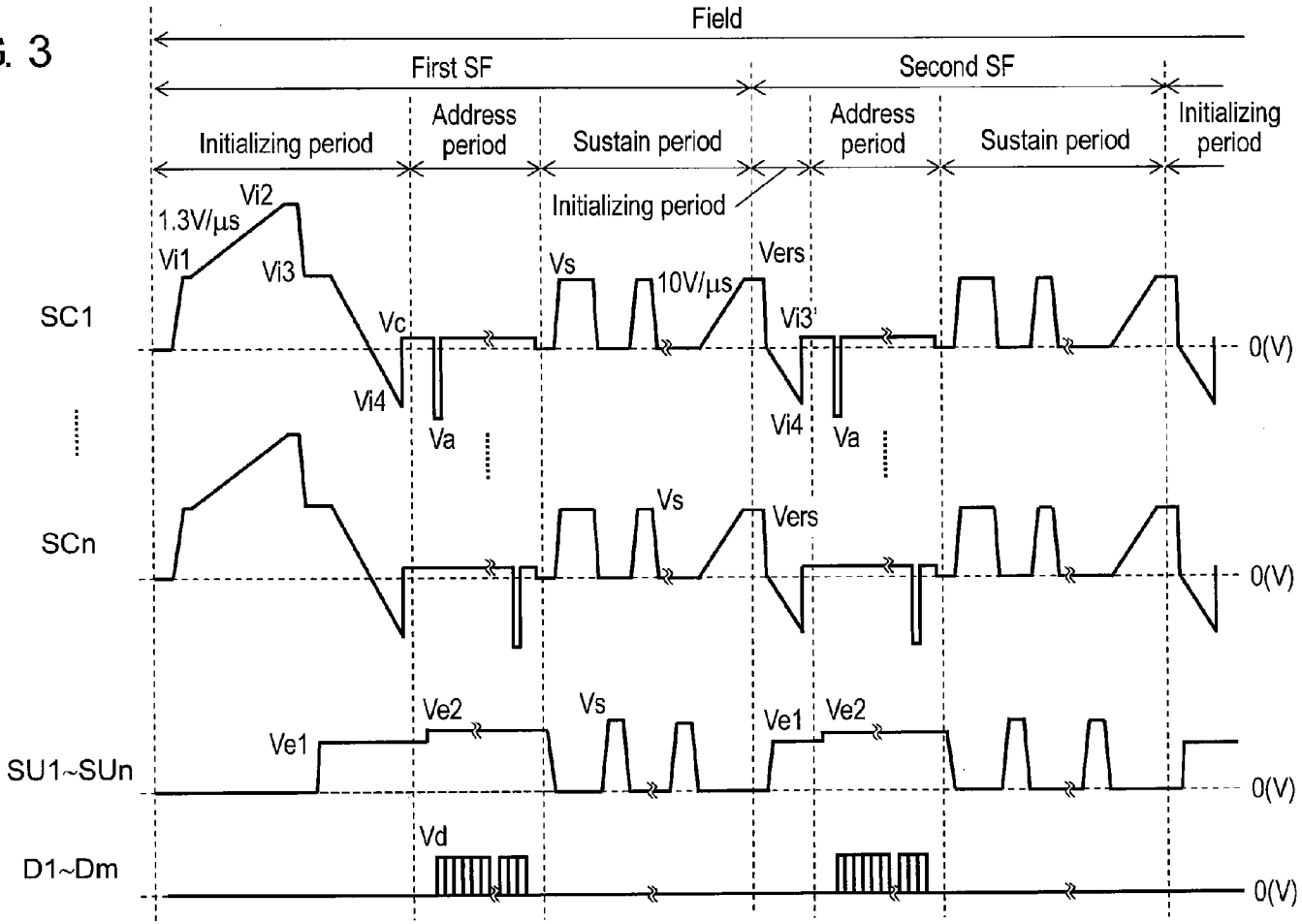
FIG. 3 is a waveform chart of driving voltage applied to each electrode of the panel.

FIG. 3 is a waveform chart of driving voltage applied to each electrode of panel 10 in accordance with the first exemplary embodiment of the present invention. FIG. 3 shows driving voltage waveforms of two subfields, namely a first subfield and a second subfield. The first subfield (first SF) is a subfield (hereinafter referred to as "all-cell initializing subfield") for performing an all-cell initializing operation, and the second subfield (second SF) is a subfield (hereinafter referred to as "selection initializing subfield") for performing a selection initializing operation. However, the driving voltage waveforms in other subfields are substantially similar to the driving voltage waveform in the second SF. Scan electrode SCi, sustain electrode SUi, and data electrode Dk described later are selected based on image data from scan electrodes, sustain electrodes, and data electrodes, respectively.

First, a first SF as the all-cell initializing subfield is described.

In the first half of the initializing period of the first SF, 0 (V) is applied to data electrode D1 through data electrode Dm and sustain electrode SU1 through sustain electrode SUn, and a ramp voltage (hereinafter referred to as "up-ramp voltage") is applied to scan electrode SC1 through scan electrode SCn. Here, the up-ramp voltage gradually increases from voltage Vi1, which is not higher than a discharge start voltage, to voltage Vi2, which is higher than the discharge start voltage, with respect to sustain electrode SU1 through sustain electrode SUn.

While the up-ramp voltage increases, feeble initializing discharge continuously occurs between scan electrode SC1 through scan electrode SCn and sustain electrode SU1 through sustain electrode SUn, and feeble initializing discharge continuously occurs between scan electrode SC1 through scan electrode SCn and data electrode D1 through data electrode Dm. Negative wall voltage is accumulated on scan electrode SC1 through scan electrode SCn, and positive wall voltage is accumulated on data electrode D1 through data electrode Dm and sustain electrode SU1 through sustain electrode SUn. Here, the wall voltage on the electrodes means the voltage generated by the wall charges accumulated on the dielectric layer covering the electrodes, the protective layer, and the phosphor layer.

In the last half of the initializing period, positive voltage Ve1 is applied to sustain electrode SU1 through sustain electrode SUn, and 0 (V) is applied to data electrode D1 through data electrode Dm. A ramp voltage (hereinafter referred to as "down-ramp voltage") is applied to scan electrode SC1 through scan electrode SCn. Here, the down-ramp voltage gradually decreases from voltage Vi3, which is not higher than the discharge start voltage, to voltage V14, which is higher than the discharge start voltage, with respect to sustain electrode SU1 through sustain electrode SUn. While the down-ramp voltage decreases, feeble initializing discharge continuously occurs between scan electrode SC1 through scan electrode SCn and sustain electrode SU1 through sustain electrode SUn, and feeble initializing discharge continuously occurs between scan electrode SC1 through scan electrode SCn and data electrode D1 through data electrode Dm. The negative wall voltage on scan electrode SC1 through scan electrode SCn and the positive wall voltage on sustain electrode SU1 through sustain electrode SUn are reduced, positive wall voltage on data electrode D1 through data electrode Dm is adjusted to a value suitable for the address operation. Thus, the all-cell initializing operation of applying initializing discharge to all discharge cells is completed.

As shown in the initializing period of the second SF of FIG. 3, a driving voltage waveform where the first half of the initializing period is omitted may be applied to each electrode. In other words, voltage Ve1 is applied to sustain electrode SU1 through sustain electrode SUn, and 0 (V) is applied to data electrode D1 through data electrode Dm, a down-ramp voltage gradually decreasing from a voltage (for example, ground potential), which is not higher than the discharge start voltage, to voltage V14 is applied to scan electrodes SC1 through SCn. In the discharge cell that has undergone the sustain discharge in the sustain period of the previous subfield, feeble initializing discharge occurs, and the wall voltages on scan electrode SCi and sustain electrode SUi are reduced. In the discharge cell where sufficient positive wall voltage is accumulated on data electrode Dk (k is 1 through m) by the adjacently previous sustain discharge, the excessive part of the wall voltage is discharged to adjust the wall voltage to be appropriate for the address operation. While, in the discharge cell where sustain discharge is not caused in the previous subfield, discharge does not occur and the wall charge at the end of the initializing period of the previous subfield is kept without variation. Such an initializing operation where the first half is omitted becomes a selection initializing operation of performing the initializing discharge in the discharge cell where sustain operation has been performed in the sustain period in the adjacently previous subfield.

In the subsequent address period, voltage Ve2 is firstly applied to sustain electrode SU1 through sustain electrode SUn, and voltage Vc is applied to scan electrode SC1 through scan electrode SCn.

Negative scan pulse voltage Va is applied to scan electrode SC1 in the first column, positive address pulse voltage Vd is applied to data electrode Dk (k is 1 through m), of data electrode D1 through data electrode Dm, in the discharge cell to emit light in the first column. At this time, the voltage difference in the intersecting part of data electrode Dk and scan electrode SC1 is derived by adding the difference between the wall voltage on data electrode Dk and that on scan electrode SC1 to the difference (Vd−Va) of the external applied voltage, and exceeds the discharge start voltage. Discharge thus occurs between data electrode Dk and scan electrode SC1. Since voltage Ve2 is applied to sustain electrode SU1 through sustain electrode SUn, the voltage difference between sustain electrode SU1 and scan electrode SC1 is derived by adding the difference between the wall voltage on sustain electrode SU1 and that on scan electrode SC1 to the difference (Ve2−Va) of the external applied voltage. At this time, by setting voltage Ve2 at a voltage value slightly lower than the discharge start voltage, a state where discharge does not occur but is apt to occur can be caused between sustain electrode SU1 and scan electrode SC1. Therefore, the discharge occurring between data electrode Dk and scan electrode SC1 can cause discharge between sustain electrode SU1 and scan electrode SC1 that exist in a region crossing data electrode Dk. Thus, address discharge occurs in the discharge cell to emit light, positive wall voltage is accumulated on scan electrode SC1, negative wall voltage is accumulated on sustain electrode SU1, and negative wall voltage is also accumulated on data electrode Dk.

Thus, an address operation of causing address discharge in the discharge cell to emit light in the first column and accumulating wall voltage on each electrode is performed. The voltage in the intersecting parts of scan electrode SC1 and data electrode D1 through data electrode Dm to which address pulse voltage Vd is not applied does not exceed the discharge start voltage, so that address discharge does not occur. This address operation is repeated until it reaches the discharge cell in the n-th column, and the address period is completed.

In the subsequent sustain period, positive sustain pulse voltage Vs is firstly applied to scan electrode SC1 through scan electrode SCn, and the ground potential as a base potential, namely 0 (V), is applied to sustain electrode SU1 through sustain electrode SUn. In the discharge cell having undergone the address discharge, the voltage difference between scan electrode SCi and sustain electrode SUi is obtained by adding the difference between the wall voltage on scan electrode SCi and that on sustain electrode SUi to sustain pulse voltage Vs, and exceeds the discharge start voltage.

Sustain discharge occurs between scan electrode SCi and sustain electrode SUi, and ultraviolet rays generated at this time cause phosphor layer 35 to emit light. Negative wall voltage is accumulated on scan electrode SCi, positive wall voltage is accumulated on sustain electrode SUi. Positive wall voltage is also accumulated on data electrode Dk. In the discharge cell where address discharge has not occurred in the address period, sustain discharge does not occur and the wall voltage at the end of the initializing period is kept.

Subsequently, 0 (V) as the base potential is applied to scan electrode SC1 through scan electrode SCn, and sustain pulse voltage Vs is applied to sustain electrode SU1 through sustain electrode SUn. In the discharge cell having undergone the sustain discharge, the voltage difference between sustain electrode SUi and scan electrode SCi exceeds the discharge start voltage. Therefore, sustain discharge occurs between sustain electrode SUi and scan electrode SCi again, negative wall voltage is accumulated on sustain electrode SUi, and positive wall voltage is accumulated on scan electrode SCi. Hereinafter, similarly, as many sustain pulses as the number derived by multiplying the luminance weight by luminance magnification are alternately applied to scan electrode SC1 through scan electrode SCn and sustain electrode SU1 through sustain electrode SUn to cause potential difference between the electrodes of display electrode pairs 24. Thus, sustain discharge is continuously performed in the discharge cell where the address discharge has been caused in the address period.

As discussed above, the present embodiment has the configuration where three kinds of sustain pulses are switched and generated so that the second sustain pulse does not continue. Here, the three kinds of sustain pulses include a first sustain pulse serving as a reference, a second sustain pulse whose rising is made gentler than that of the first sustain pulse, and a third sustain pulse whose rising is made steeper than that of the first sustain pulse. Thus, the sustain discharge is stabilized to uniform the display luminance of each discharge cell while the power consumption of panel 10 is reduced, thereby improving the image display quality of panel 10.

At the end of the sustain period, a ramp voltage (hereinafter referred to as "erasing ramp voltage") is applied to scan electrode SC1 through scan electrode SCn. Here, the erasing ramp voltage gradually increases from 0 (V) as the base potential to voltage Vers. Thus, feeble discharge is continuously caused, and a part or the whole of the wall voltages on scan electrode SCi and sustain electrode SUi is erased while positive wall voltage is left on data electrode Dk.

Specifically, sustain electrode SU1 through sustain electrode SUn are returned to 0 (V), then the erasing ramp voltage, which increases from 0 (V) as the base potential to voltage Vers higher than the discharge start voltage, is applied to scan electrode SC1 through scan electrode SCn. Then, feeble discharge occurs between sustain electrode SUi and scan electrode SCi in the discharge cell having undergone the sustain discharge. This feeble discharge is continuously caused while the voltage applied to scan electrode SC1 through scan electrode SCn increases.

At this time, charged particles generated by the feeble discharge are accumulated on sustain electrode SUi and scan electrode SCi to form wall charge so as to reduce the voltage difference between sustain electrode SUi and scan electrode SCi. Thus, while positive wall charge is left on data electrode Dk, the wall voltage between scan electrode SC1 through scan electrode SCn and sustain electrode SU1 through sustain electrode SUn is decreased to the extent of the difference between the voltage applied to scan electrode SCi and the discharge start voltage, namely (voltage Vers—discharge start voltage). The last discharge in the sustain period caused by the erasing ramp voltage is called "erasing discharge".

The operation of the subsequent subfield is substantially similar to the above-mentioned operation except for the number of sustain pulses in the sustain period, and is not described. The outline of the driving voltage waveform to be applied to each electrode of panel 10 of the present embodiment has been described.

Figure 4:
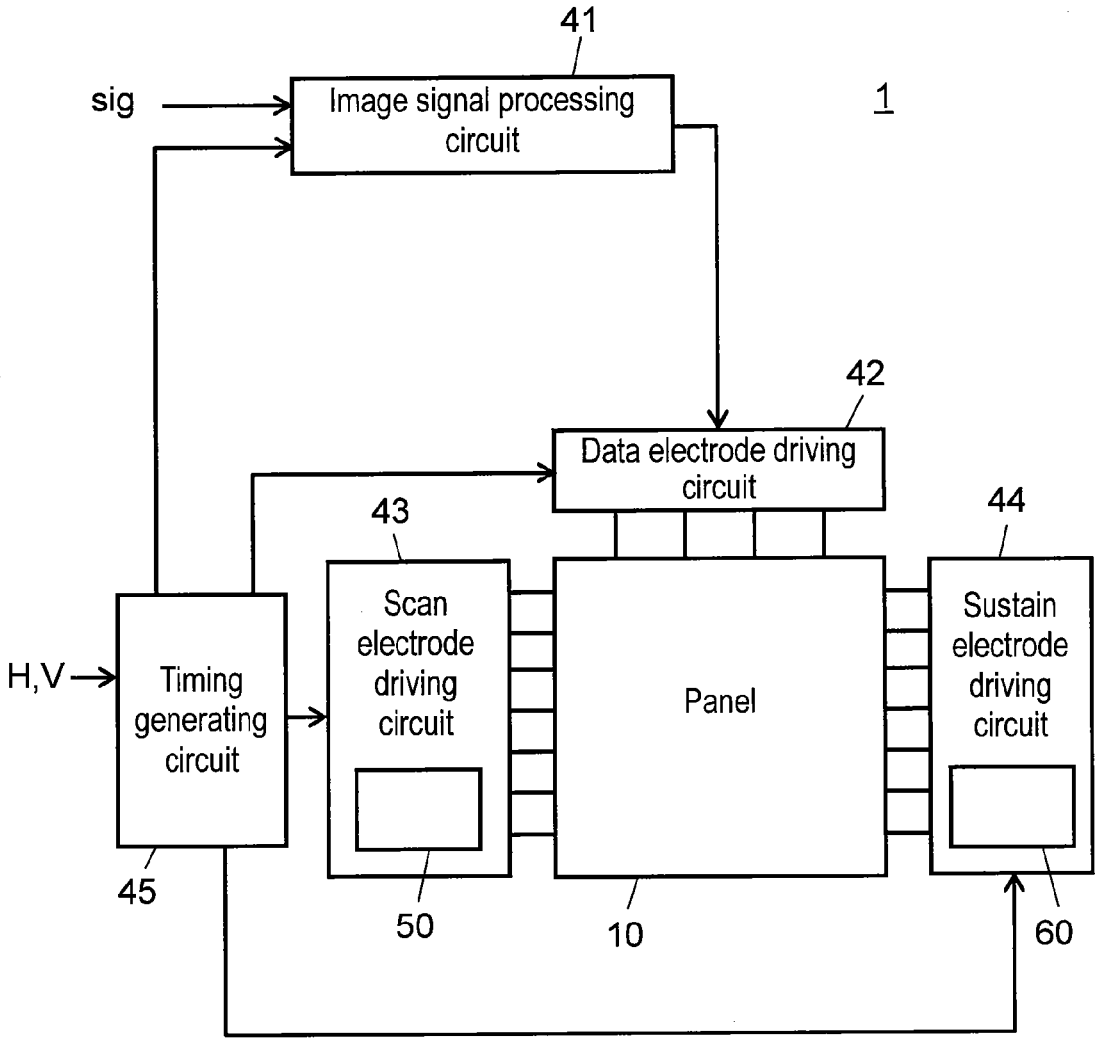
FIG. 4 is a circuit block diagram of a plasma display device in accordance with the first exemplary embodiment.

Next, a configuration of the plasma display device of the present embodiment is described. FIG. 4 is a circuit block diagram of the plasma display device of the first exemplary embodiment of the present invention. Plasma display device 1 has the following elements:

- panel 10;
- image signal processing circuit 41;
- data electrode driving circuit 42;
- scan electrode driving circuit 43;
- sustain electrode driving circuit 44;
- timing generating circuit 45; and
- a power supply circuit (not shown) for supplying power required for each circuit block.

Image signal processing circuit 41 converts input image signal sig into image data that indicates emission or non-emission of light in each subfield. Data electrode driving circuit 42 converts the image data in each subfield into a signal corresponding to each of data electrode D1 through data electrode Dm, and drives each of data electrode D1 through data electrode Dm.

Timing generating circuit 45 generates various timing signals for controlling operations of respective circuit blocks based on horizontal synchronizing signal H and vertical synchronizing signal V, and supplies them to respective circuit blocks. In the present embodiment, as discussed above, timing generating circuit 45 switches the "rising period" in rising of the sustain pulse among three different lengths, and outputs a timing signal responsive to the switched length to scan electrode driving circuit 43 and sustain electrode driving circuit 44. Thus, the power consumption is reduced and the sustain discharge is stabilized.

Scan electrode driving circuit 43 has the following elements:

- an initializing waveform generating circuit (not shown) for generating initializing voltage to be applied to scan electrode SC1 through scan electrode SCn in the initializing period;
- sustain pulse generating circuit 50 for generating a sustain pulse to be applied to scan electrode SC1 through scan electrode SCn in the sustain period; and
- a scan pulse generating circuit (not shown) for generating scan pulse voltage to be applied to scan electrode SC1 through scan electrode SCn in the address period.

Scan electrode driving circuit 43 drives each of scan electrode SC1 through scan electrode SCn based on the timing signal. Sustain electrode driving circuit 44 has sustain pulse generating circuit 60 and a circuit for generating voltage Ve1 and voltage Ve2, and drives sustain electrode SU1 through sustain electrode SUn based on the timing signal.

Figure 5:
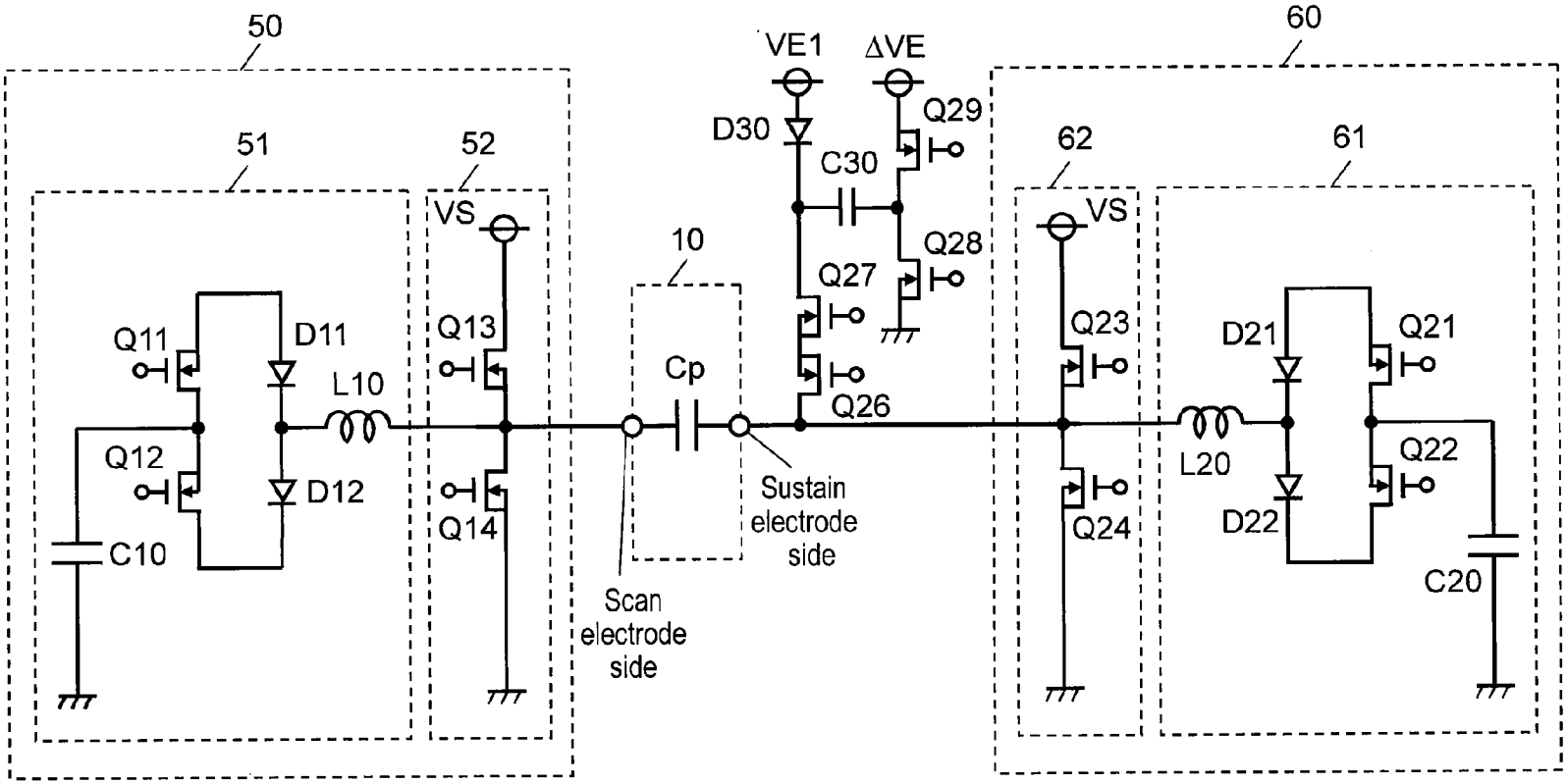
FIG. 5 is a circuit diagram of a sustain pulse generating circuit in accordance with the first exemplary embodiment.

Next, the detail and the operation of sustain pulse generating circuit 50 and sustain pulse generating circuit 60 are described. FIG. 5 is a circuit diagram of sustain pulse generating circuit 50 and sustain pulse generating circuit 60 in accordance with the first exemplary embodiment of the present invention. In FIG. 5, the inter-electrode capacity of panel 10 is denoted with Cp, and the circuit for generating a scan pulse and initializing voltage waveform is omitted.

Sustain pulse generating circuit 50 has electric power recovering circuit 51 and clamping circuit 52. Electric power recovering circuit 51 and clamping circuit 52 are connected to scan electrode SC1 through scan electrode SCn, which are one end of inter-electrode capacity Cp of panel 10 via the scan pulse generating circuit (not shown because it comes into a short circuit state during the sustain period).

Electric power recovering circuit 51 has capacitor C10 for recovering electric power, switching element Q11, switching element Q12, diode D11 for preventing back flow, diode D12 for preventing back flow, and inductor L10 for resonance Electric power recovering circuit 51 LC-resonates inter-electrode capacity Cp and inductor L10 to raise and fall the sustain pulse. Thus, electric power recovering circuit 51 drives scan electrode SC1 through scan electrode SCn by LC-resonance without power from the power supply, so that the power consumption is 0 ideally. Capacitor C10 for recovering electric power has a capacity sufficiently larger than inter-electrode capacity Cp, and is charged up to about Vs/2, namely a half voltage value Vs, so as to work as the power supply of electric power recovering circuit 51.

Clamping circuit 52 has switching element Q13 for clamping scan electrode SC1 through scan electrode SCn on voltage Vs, and switching element Q14 for clamping scan electrode SC1 through scan electrode SCn on 0 (V) as the base potential. Clamping circuit 52 clamps scan electrode SC1 through scan electrode SCn on voltage Vs by connecting them to power supply VS via switching element Q13, and clamps scan electrode SC1 through scan electrode SCn on 0 (V) by grounding them via switching element Q14. Therefore, the impedance during voltage application by clamping circuit 52 is small, and large discharge current by strong sustain discharge can be stably made to flow.

Sustain pulse generating circuit 50 switches conduction and breaking of switching element Q11, switching element Q12, switching element Q13, and switching element Q14 in response to the timing signal output from timing generating circuit 45, thereby operating electric power recovering circuit 51 and clamping circuit 52 and generating a sustain pulse.

For example, in raising a sustain pulse, switching element Q11 is set at ON to resonate inter-electrode capacity Cp and inductor L10, and electric power is supplied from capacitor C10 for recovering electric power to scan electrode SC1 through scan electrode SCn via switching element Q11, diode D11, and inductor L10. When the voltage of scan electrode SC1 through scan electrode SCn approaches voltage Vs, switching element Q13 is set at ON, a circuit for driving scan electrode SC1 through scan electrode SCn is switched from electric power recovering circuit 51 to clamping circuit 52, and scan electrode SC1 through scan electrode SCn are clamped on voltage Vs. In the present embodiment, the rising of the sustain pulse is controlled by controlling the driving time by electric power recovering circuit 51.

While, in falling a sustain pulse, switching element Q12 is set at ON to resonate inter-electrode capacity Cp and inductor L10, and electric power is recovered from inter-electrode capacity Cp to capacitor C10 for recovering electric power via inductor L10, diode D12, and switching element Q12. When the voltage of scan electrode SC1 through scan electrode SCn approaches 0 (V), switching element Q14 is set at ON, a circuit for driving scan electrode SC1 through scan electrode SCn is switched from electric power recovering circuit 51 to clamping circuit 52, and scan electrode SC1 through scan electrode SCn are clamped on voltage 0 (V) as the base potential.

Thus, sustain pulse generating circuit 50 generates a sustain pulse. These switching elements can be formed of a generally known element such as a metal oxide semiconductor field effect transistor (MOSFET) or an insulated gate bipolar transistor (IGBT).

Sustain pulse generating circuit 60 has a configuration substantially the same as that of sustain pulse generating circuit 50. Sustain pulse generating circuit 60 has the following elements:

- electric power recovering circuit 61 that has capacitor C20 for recovering electric power, switching element Q21, switching element Q22, diode D21 for preventing back flow, diode D22 for preventing back flow, and inductor L20 for resonance, and recovers and recycles the electric power for driving sustain electrode SU1 through sustain electrode SUn; and
- clamping circuit 62 having switching element Q23 for clamping sustain electrode SU1 through sustain electrode SUn on voltage Vs, and switching element Q24 for clamping sustain electrode SU1 through sustain electrode SUn on ground potential (0 (V)).

Sustain pulse generating circuit 60 is connected to sustain electrode SU1 through sustain electrode SUn as one end of inter-electrode capacity Cp of panel 10. The operation of sustain pulse generating circuit 60 is similar to that of sustain pulse generating circuit 50, and is not described.

FIG. 5 shows the following elements:

- power supply VE1 for generating voltage Ve1;
- switching element Q26 and switching element Q27 for applying voltage Ve1 to sustain electrode SU1 through sustain electrode SUn;
- power supply ΔVE for generating voltage ΔVe;
- diode D30 for preventing back flow;
- capacitor C30 for a charge pump for adding voltage ΔVe to voltage Ve1;
- switching element Q28 and switching element Q29 for adding voltage ΔVe to voltage Ve1 to generate voltage Ve2.

At the timing when voltage Ve1 is applied in FIG. 3, for example, switching element Q26 and switching element Q27 are conducted, and positive voltage Ve1 is applied to sustain electrode SU1 through sustain electrode SUn via diode D30, switching element Q26, and switching element Q27. At this time, switching element Q28 is conducted to charge capacitor C30 so that its voltage becomes voltage Ve1. At the timing when voltage Ve2 is applied in FIG. 3, for example, switching element Q28 is broken while switching element Q26 and switching element Q27 are conducted. Additionally, switching element Q29 is conducted to superimpose voltage ΔVe on the voltage of capacitor C30, and voltage (Ve1+ΔVe), namely voltage Ve2, is applied to sustain electrode SU1 through sustain electrode SUn. At this time, diode D30 for preventing back flow works to break the current from capacitor C31 to power supply VE1.

The circuit for applying voltage Ve1 and voltage Ve2 is not limited to the circuit shown in FIG. 5, but the following configuration may be employed, for example. Using a power supply for generating voltage Ve1, a power supply for generating voltage Ve2, and a plurality of switching elements for applying respective voltages to sustain electrode SU1 through sustain electrode SUn, the voltages are applied to sustain electrode SU1 through sustain electrode SUn at a required timing.

Figure 6:
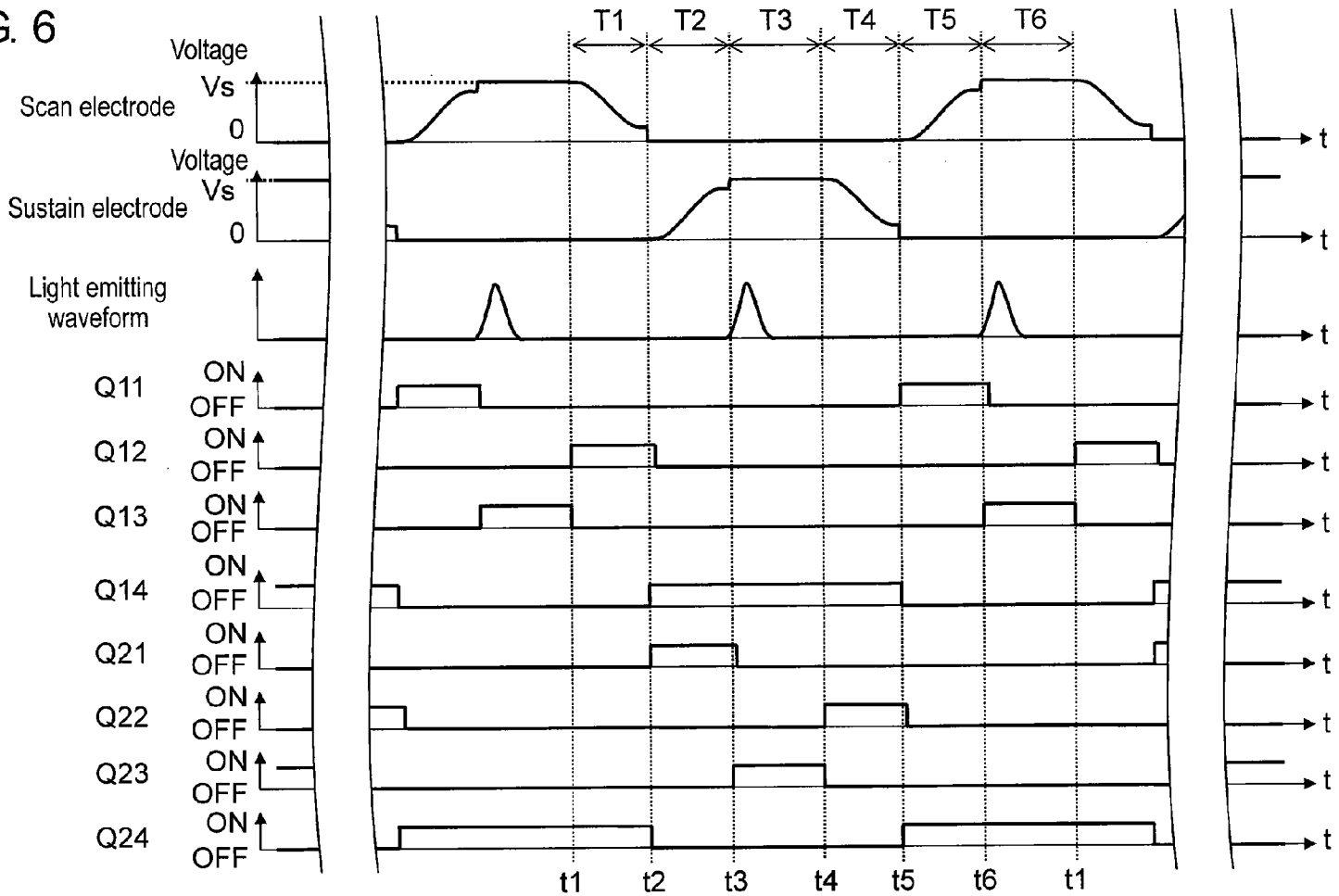
FIG. 6 is a timing chart for illustrating the operation of the sustain pulse generating circuit.

Next, the driving voltage waveform in the sustain period is described in detail. FIG. 6 is a timing chart for illustrating the operation of sustain pulse generating circuit 50 and sustain pulse generating circuit 60 in accordance with the first exemplary embodiment of the present invention. First, one of repetition cycles of the sustain pulse is divided into six time periods T1 through T6, and each time period is described. The repetition cycles (hereinafter referred to as "sustain cycles") mean the intervals of the sustain pulses repeatedly applied to a display electrode pair in the sustain period, for example, show the cycles repeated in time periods T1 through T6.

In the following description, the operation of conducting a switching element is denoted with ON, and the operation of breaking it is denoted with OFF. In the drawings, a signal for setting a switching element at ON is denoted with "ON", and a signal for setting a switching element at OFF is denoted with "OFF". FIG. 6 illustrates the operation using a positive electrode waveform, and the present invention is not limited to this. For example, the embodiment employing a negative electrode waveform is omitted. When "rising" and "falling" in the positive electrode waveform are replaced by "falling" and "rising" in the negative electrode waveform in the following description, respectively, however, the negative electrode waveform can produce a similar effect.

(Time Period T1)

Switching element Q12 is set at ON at time t1. At this time, charge on the side of scan electrode SC1 through scan electrode SCn starts to flow to capacitor C10 via inductor L10, diode D12, and switching element Q12, and the voltage of scan electrode SC1 through scan electrode SCn starts to decrease. Inductor L10 and inter-electrode capacity Cp form a resonance circuit, so that the voltage of scan electrode SC1 through scan electrode SCn decreases to a voltage close to 0 (V) at time t2 after a lapse of a half the resonance cycle (here, it is set at 2000 nsec). However, due to electric power loss by a resonance component or the like of the resonance circuit, the voltage of scan electrode SC1 through scan electrode SCn does not decrease to 0 (V).

During this operation, switching element Q24 is kept at ON, and sustain electrode SU1 through sustain electrode SUn are clamped on 0 (V).

(Time period T2)

Switching element Q14 is set at ON at time t2. Then, scan electrode SC1 through scan electrode SCn are directly grounded via switching element Q14, so that the voltage of scan electrode SC1 through scan electrode SCn is clamped on 0 (V) as the ground potential.

Simultaneously, switching element Q21 is set at ON at time t2. Then, current starts to flow from capacitor C20 for recovering electric power to sustain electrode SU1 through sustain electrode SUn via switching element Q21, diode D21, and inductor L20, and the voltage of sustain electrode SU1 through sustain electrode SUn starts to increase. Inductor L20 and inter-electrode capacity Cp form a resonance circuit, so that the voltage of sustain electrode SU1 through sustain electrode SUn increases to a voltage close to Vs at time t3 after a lapse of a half the resonance cycle (here, it is set at 2000 nsec). Due to the output impedance of the driving circuit or an effect of the driving load, however, the voltage of sustain electrode SU1 through sustain electrode SUn does not increase to Vs.

In the present embodiment, the rising of the sustain pulse is controlled by controlling the lengths of time period T2 and time period T5, and the first sustain pulse, the second sustain pulse, and the third sustain pulse are generated.

(Time Period T3)

Switching element Q23 is set at ON at time t3. Then, sustain electrode SU1 through sustain electrode SUn are directly connected to power supply VS via switching element Q23, so that the voltage of sustain electrode SU1 through sustain electrode SUn is clamped on voltage Vs and forcibly increased to voltage Vs. In time period T3, the voltage of sustain electrode SU1 through sustain electrode SUn is kept at voltage Vs.

(Time Periods T4 Through T6)

The sustain pulse applied to scan electrode SC1 through scan electrode SCn has the same waveform as that of the sustain pulse applied to sustain electrode SU1 through sustain electrode SUn. The operation from time period T4 to time period T6 is the same as the operation obtained by interchanging scan electrode SC1 through scan electrode SCn and sustain electrode SU1 through sustain electrode SUn in the operation from time period T1 to time period T3, and is not described.

In the present embodiment, time period T1 and time period T4 are set as "falling period", time period T2 and time period T5 are set as "rising period", and the lengths of these time periods are set at required values. Thus, "rising period" and "falling period" are set.

Switching element Q12 is simply required to be set at OFF after time t2 before time t5, and switching element Q21 is simply required to be set at OFF after time t3 before time t4. Switching element Q22 is simply required to be set at OFF after time t5 before time t2 of the next cycle, and switching element Q11 is simply required to be set at OFF after time t6 before time t1 of the next cycle. In order to decrease the output impedance of sustain pulse generating circuit 50 and sustain pulse generating circuit 60, preferably, switching element Q24 is set at OFF immediately before time t2, switching element Q13 is set at OFF immediately before time t1, switching element Q14 is set at OFF immediately before time t5, and switching element Q23 is set at OFF immediately before time t4.

In the sustain period, the operation of time period T1 through time period T6 is repeated in response to the number of required pulses. Thus, sustain pulse voltage varying from 0 (V) as the base potential to voltage Vs is alternately applied to display electrode pairs 24 to cause sustain discharge in the discharge cells.

The cycle (hereinafter referred to as "resonance cycle") of the LC resonance of inductor L10 of electric power recovering circuit 51 and inter-electrode capacity Cp of panel 10 and the cycle of the LC resonance of inductor L20 of electric power recovering circuit 61 and inter-electrode capacity Cp can be determined using expression "$2\pi\sqrt{(LCp)}$" when the inductance of each of inductor L10 and inductor L20 is denoted with L. In the present embodiment, inductor L10 and inductor L20 are set so that the resonance cycle of electric power recovering circuit 51 and electric power recovering circuit 61 is 2000 nsec.

Next, three kinds of sustain pulses of the present embodiment are described. The waveforms of the three kinds of sustain pulses are firstly described, and the reason for performing the driving using the three kinds of sustain pulses is then described.

Figure 7A:
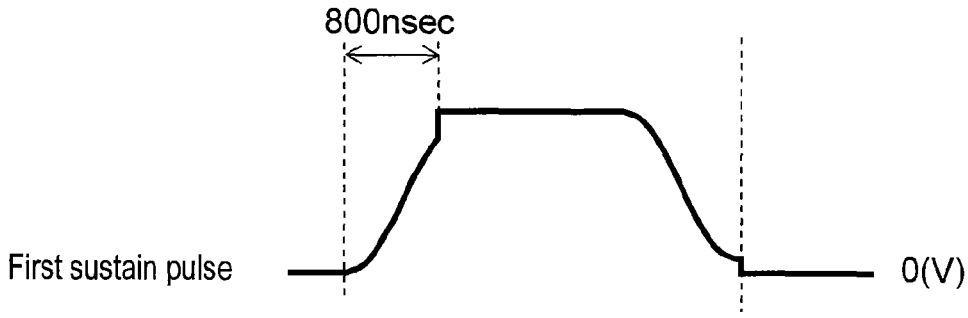
FIG. 7A is a schematic waveform chart of a first sustain pulse in accordance with the first exemplary embodiment.
Figure 7B:
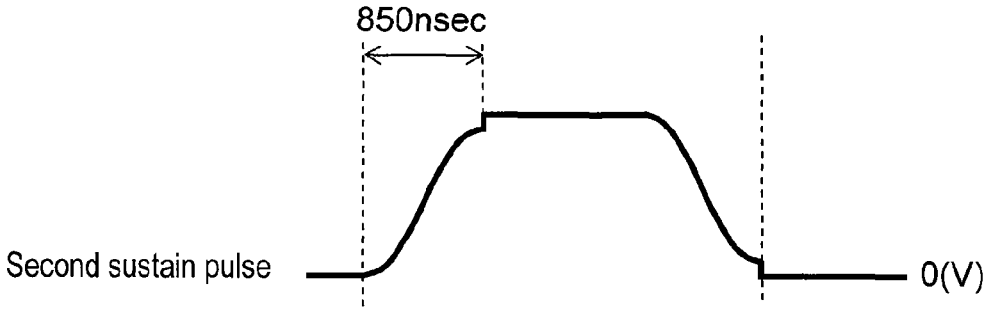
FIG. 7B is a schematic waveform chart of a second sustain pulse in accordance with the first exemplary embodiment.
Figure 7C:
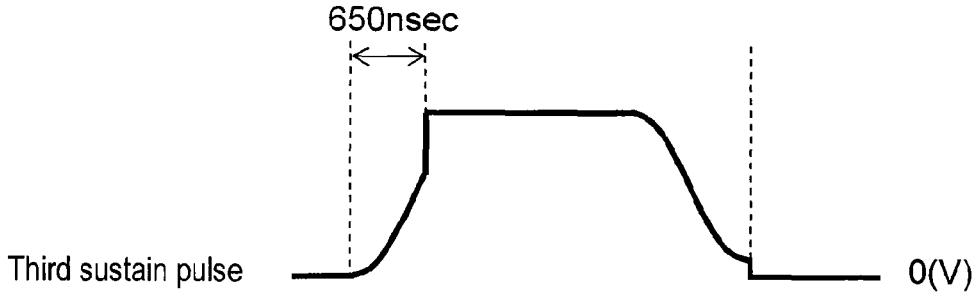
FIG. 7C is a schematic waveform chart of a third sustain pulse in accordance with the first exemplary embodiment.

FIG. 7A through FIG. 7C are schematic waveform charts showing three kinds of sustain pulses for comparison in accordance with the first exemplary embodiment of the present invention. FIG. 7A is a schematic waveform chart of the first sustain pulse, FIG. 7B is a schematic waveform chart of the second sustain pulse, and FIG. 7C is a schematic waveform chart of a third sustain pulse. In the present embodiment, three kinds of sustain pulses having different waveforms are switched and generated. However, simply, the waveforms of the sustain pulses are changed by controlling the driving time of each electric power recovering circuit and each voltage clamping circuit by controlling the switching timing of each switching element of sustain pulse generating circuit 50 and sustain pulse generating circuit 60, as discussed above.

In the present embodiment, as shown in FIG. 7A through FIG. 7C, three kinds of sustain pulses having different waveforms are generated. In other words, the three kinds of sustain pulses include a first sustain pulse (FIG. 7A) serving as the reference, a second sustain pulse (FIG. 7B) whose rising is gentler than that of the first sustain pulse, and a third sustain pulse (FIG. 7C) whose rising is steeper than that of the first sustain pulse.

Specifically, the first sustain pulse as the reference sustain pulse is generated while "rising period" is set at about 800 nsec as shown in FIG. 7A. The second sustain pulse, as shown in FIG. 7B, is generated while the rising is made gentler than that of the first sustain pulse by setting "rising period" at about 850 nsec, which is longer than that of the first sustain pulse. The third sustain pulse, as shown in FIG. 7C, is generated while the rising is made steeper than that of the first sustain pulse by setting "rising period" at about 650 nsec, which is shorter than that of the first sustain pulse.

In the present embodiment, the reason why three kinds of sustain pulses having different rising waveforms are generated is described below.

When the driving load is increased by increasing the screen size and definition of panel 10, the rising waveform of the sustain pulse is apt to vary and the timing (discharge start time) of causing the discharge between discharge cells can vary.

While, in a panel where the xenon partial pressure is increased in order to improve the luminous efficiency, the discharge start voltage between display electrode pairs also increases and hence the variation in timing of causing the discharge is apt to further increase.

When the timing of causing the discharge varies between adjacent discharge cells, the light emission intensity in the discharge cell having undergone discharge ahead differs from that in the discharge cell having undergone discharge later, and hence the light emission luminance on the display surface of the panel can vary. This phenomenon occurs for the following reasons, for example. The wall charge of the discharge cell undergoing discharge later is reduced due to the effect of the discharge cell undergoing discharge ahead to slightly weaken the discharge. Alternatively, the discharge started once is temporarily stopped by the effect of the discharge of an adjacent discharge cell and then the discharge is caused again by increase in applied voltage, thereby weakening the discharge.

The luminance of the discharge cell has a correlation to the number of sustain discharges in one field and light emission intensity in one sustain discharge, so that the above-mentioned phenomena causes the luminance to vary between discharge cells.

In order to solve this problem, it is effective to cause discharge in a state where the variation in voltage is steep. Here, "rising period" of the sustain pulse and variation in discharge are described with reference to the drawings.

Figure 8:
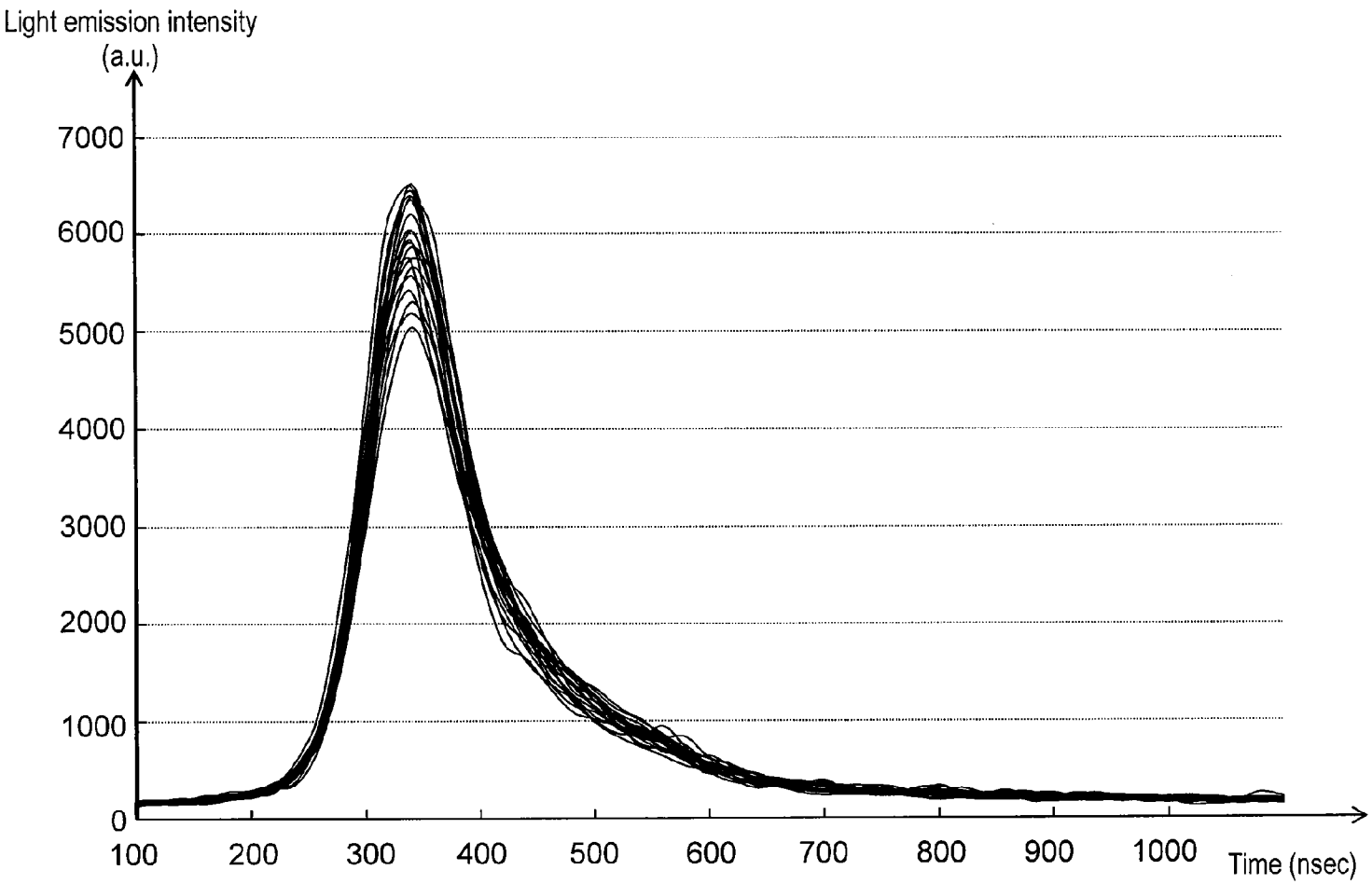
FIG. 8 is a waveform chart showing the relation between "rising period" of the sustain pulses and discharge variation in accordance with the first exemplary embodiment.
Figure 9:
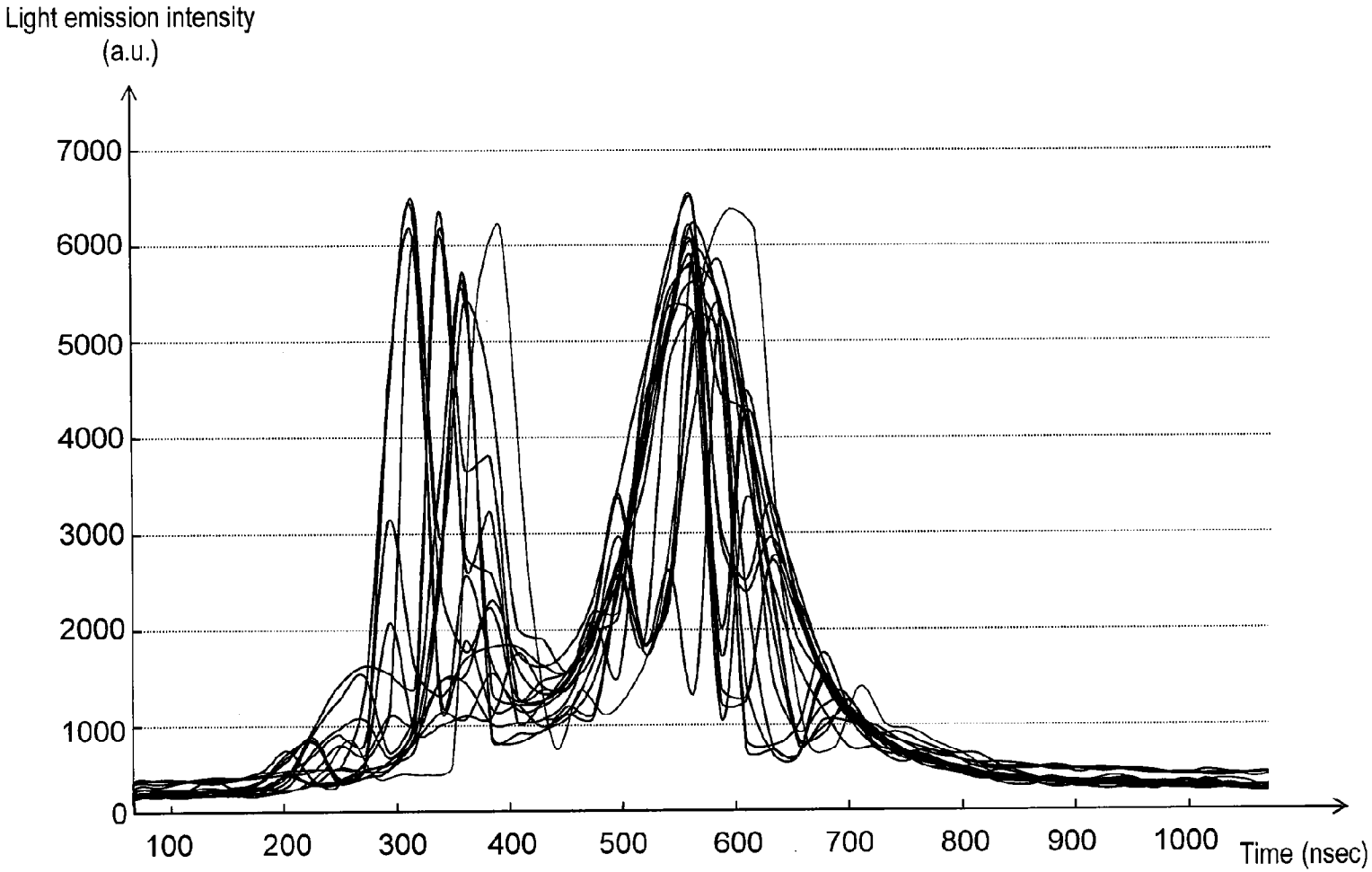
FIG. 9 is another waveform chart showing the relation between the "rising period" of the sustain pulses and discharge variation in accordance with the first exemplary embodiment.
Figure 10:
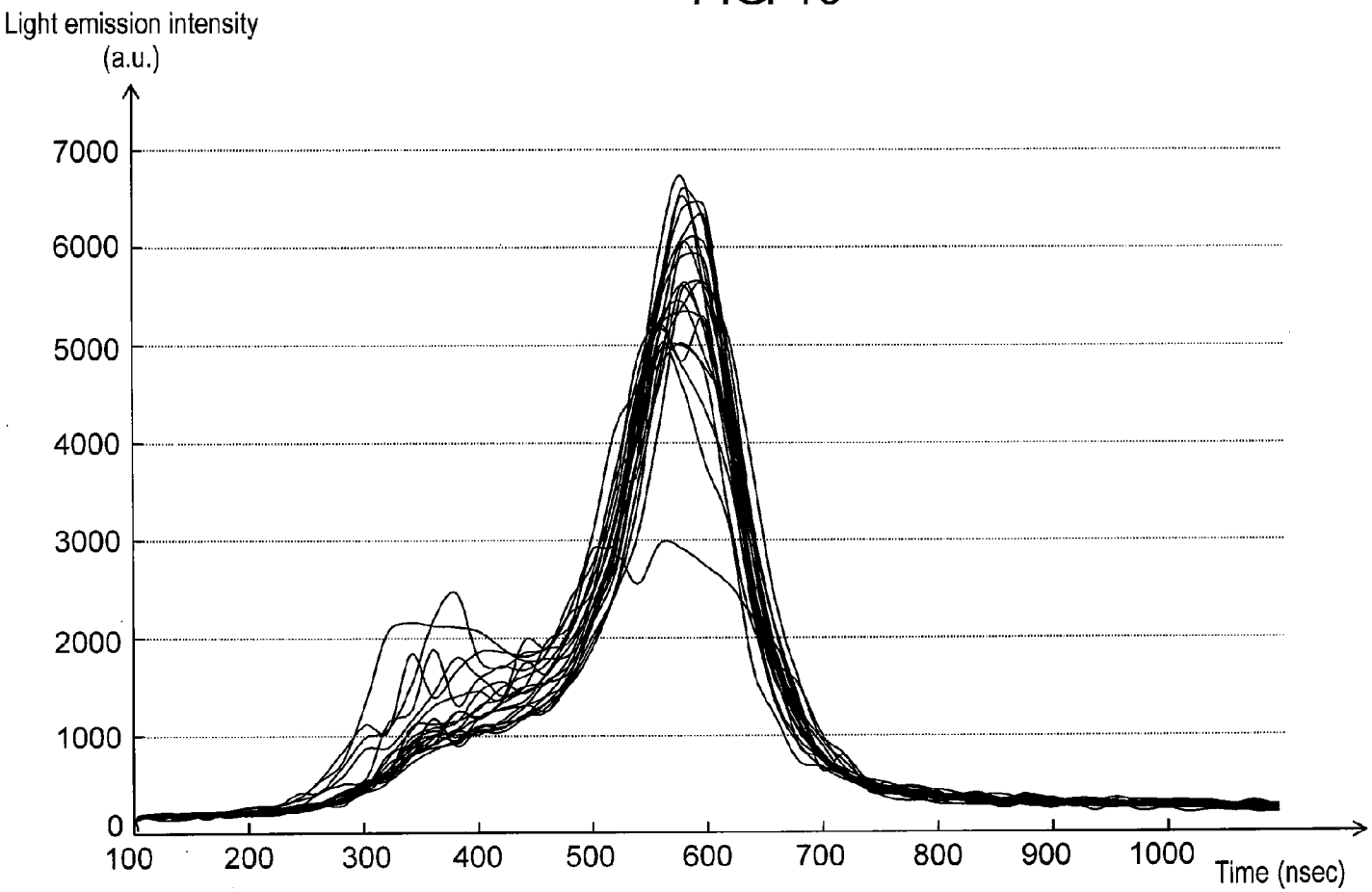
FIG. 10 is yet another waveform chart showing the relation between the "rising period" of the sustain pulses and discharge variation in accordance with the first exemplary embodiment.

FIG. 8, FIG. 9, and FIG. 10 are characteristic diagrams showing the relation between the "rising period" of the sustain pulses and discharge variation in accordance with the first exemplary embodiment of the present invention. Here, an experiment is performed while the resonance cycle of the electric power recovering circuit is set at 1200 nsec, one cycle length of the sustain pulse is set at 2.7 μsec, the "falling period" is set at 900 nsec, and the "rising period" is changed among 400 nsec, 500 nsec, and 550 nsec. FIG. 8 is a diagram showing the measurement results when the "rising period" is set at 400 nsec, FIG. 9 is a diagram showing the measurement results when the "rising period" is set at 500 nsec, and FIG. 10 is a diagram showing the measurement results when the "rising period" is set at 550 nsec. In FIG. 8, FIG. 9, and FIG. 10, the measurement results of a plurality of discharge cells are made to overlap in one graph.

In each of FIG. 8, FIG. 9, and FIG. 10, the vertical axis shows light emission intensity, and the horizontal axis shows the elapsed time since start of the operation of the electric power recovering circuit. Unit (a.u.) of the vertical axis shows an arbitrary unit.

For example, when the "rising period" is set at 400 nsec, which is relatively short, and the rising of the sustain pulse is made steep, it is recognized that most of the discharge cells emit light at substantially the same time and variation in discharge is suppressed.

When the rising of the sustain pulse is made steep and discharge is caused in a state of steep voltage variation, the variation in discharge start voltage is absorbed, variation in timing of causing discharge between discharge cells can be reduced and occurrence of variation in luminance can be suppressed.

When discharge is caused in a state of steep voltage variation, strong sustain discharge occurs to produce sufficient wall charge in the discharge cell and hence subsequent sustain discharge can be caused stably.

In the present embodiment, the "rising period" of the third sustain pulse is shortened to a length that allows light emission having one peak shown in FIG. 8 to occur in the discharge cell, and the rising is made sufficiently steep. Thus, variation in timing of causing discharge between discharge cells is suppressed, and strong discharge is caused as a sustain pulse capable of producing sufficient wall charge in the discharge cells.

When the "rising period" of the sustain pulse is shortened to make the rising steep, however, the following problems occur. The operation period of the electric power recovering circuit decreases correspondingly to the shortening, the recovery efficiency of the electric power decreases, and power consumption increases.

The power consumption and the "rising period" are described hereinafter. The luminous efficiency and reactive power are considered as main items affecting the power consumption, so that the relations between these items and the "rising period" are sequentially described.

Figure 11:
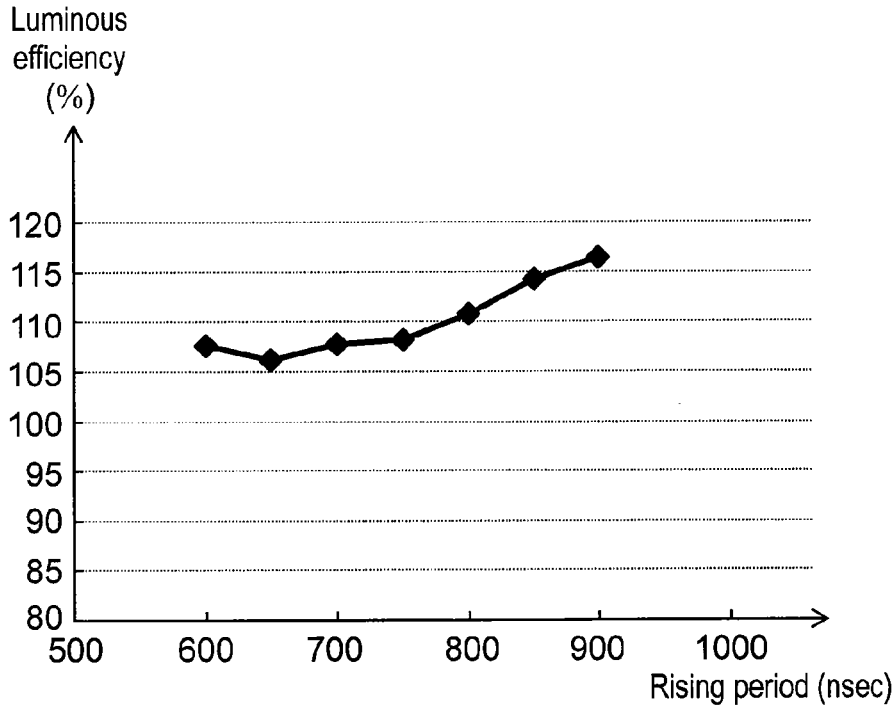
FIG. 11 is a characteristic diagram showing the relation between the "rising period" of the sustain pulses and luminous efficiency in accordance with the first exemplary embodiment.

FIG. 11 is a characteristic diagram showing the relation between the "rising period" of the sustain pulses and luminous efficiency in accordance with the first exemplary embodiment of the present invention. In FIG. 11, the vertical axis shows the relative value of the luminous efficiency, and the horizontal axis shows the length of the "rising period". The unit (%) on the vertical axis is the ratio of the detection result of the luminous efficiency (1 m/W: light emission luminance per unit electric power) to a predetermined value (100%), and the luminous efficiency is better when its value is higher.

Figure 12:
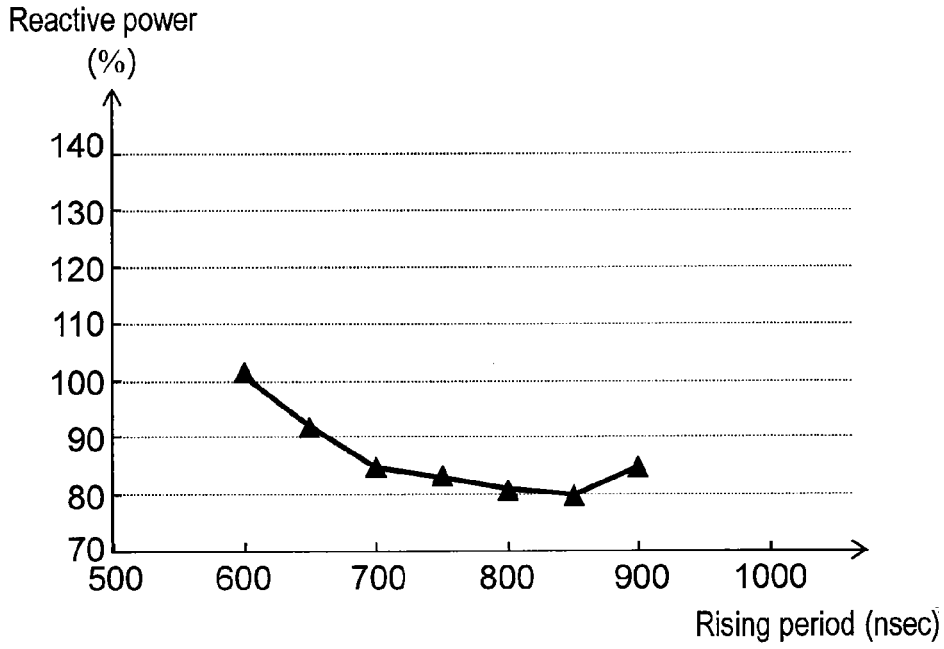
FIG. 12 is a characteristic diagram showing the relation between the "rising period" and reactive power.

FIG. 12 is a characteristic diagram showing the relation between the "rising period" and reactive power in accordance with the first exemplary embodiment of the present invention. In FIG. 12, the vertical axis shows the relative value of the reactive power, and the horizontal axis shows the length of the "rising period". The unit (%) on the vertical axis is the ratio of the detection result of the reactive power (W) to a predetermined value (100%), and the reactive power is larger when its value is higher.

In FIG. 11 and FIG. 12, the resonance cycle of the electric power recovering circuit is set at 2000 nsec, the length of one cycle of the sustain pulses is set at 2.7 μsec, the "falling period" is set at 900 nsec, and the "rising period" is varied from 600 nsec to 900 nsec by 50 nsec.

According to FIG. 11 and FIG. 12, as the length of the "rising period", namely the operation period of the electric power recovering circuit, is increased, the luminous efficiency is improved and the reactive power is reduced. That is because increasing the "rising period" increases the percentage by which the electric power recovered by the electric power recovering circuit is used for causing discharge.

In order to reduce the power consumption by increasing the recovery efficiency of the electric power in the electric power recovering circuit, the period when the electric power recovering circuit is operated is required to be as long as possible. In other words, the "rising period" of the sustain pulse is made as long as possible to moderate the rising.

When the "rising period" is made longer (here, it is set at 500 nsec longer by 100 nsec) than the "rising period" (400 nsec) of the sustain pulses used for measuring the characteristic of FIG. 8, however, the light emission time of the discharge cell varies as shown in FIG. 9, the light emission having two peaks is caused in the discharge cell, and the variation in discharge increases.

When the "rising period" is further made longer (here, it is set at 550 nsec further longer by 50 nsec) than the "rising period" (500 nsec) of the sustain pulses used for measuring the characteristic of FIG. 9 and the rising of the sustain pulse is further moderated, as shown in FIG. 10, most of the discharge cells emit light at substantially the same time as the timing of the second peak (later peak) of the light emission having two peaks shown in FIG. 9 to cause light emission having one peak, and the variation in discharge can be suppressed. That is because the "rising period" is sufficiently long and hence discharge for generating second peak of light emission shown in FIG. 9 strongly occurs in most of the discharge cells.

According to this experiment, sufficiently moderating the rising of the sustain pulse can suppress the variation in discharge similarly to the sustain pulse whose rising is made steep. In other words, the variation in discharge can be reduced by extending the "rising period" in the sustain pulse to a length at which light emission having one peak can be caused in most discharge cells so as to provide the characteristic of FIG. 10.

In the present embodiment, the "rising period" of the generated second sustain pulse is extended to a length at which light emission having one peak can be caused in the discharge cells so as to provide the characteristic of FIG. 10, and the rising is sufficiently moderated. Therefore, the second sustain pulse can improve the recovery efficiency in the electric power recovering circuit, and suppress the variation in timing of causing discharge between the discharge cells.

However, the discharge caused by gentle voltage increase is relatively weak and sufficient wall charge is hardly produced in the discharge cells disadvantageously, though the sustain pulse whose rising is steep causes relatively strong discharge by the steep voltage variation. In the sustain period, the wall voltage produced by a sustain discharge is used for its subsequent sustain discharge, thereby continuously causing the sustain discharge. The light emission intensity in the subsequent sustain discharge depends on the wall voltage produced by the sustain discharge immediately before it. In other words, when the sustain pulses whose rising is gentle are continuously generated, sufficient wall voltage cannot be produced and generation of sustain discharge gradually becomes difficult, disadvantageously. This is clear also from the characteristic diagram showing the relation between the "rising period" of the sustain pulses and sustain pulse voltage Vs required for stably causing the sustain discharge in FIG. 13.

Figure 13:
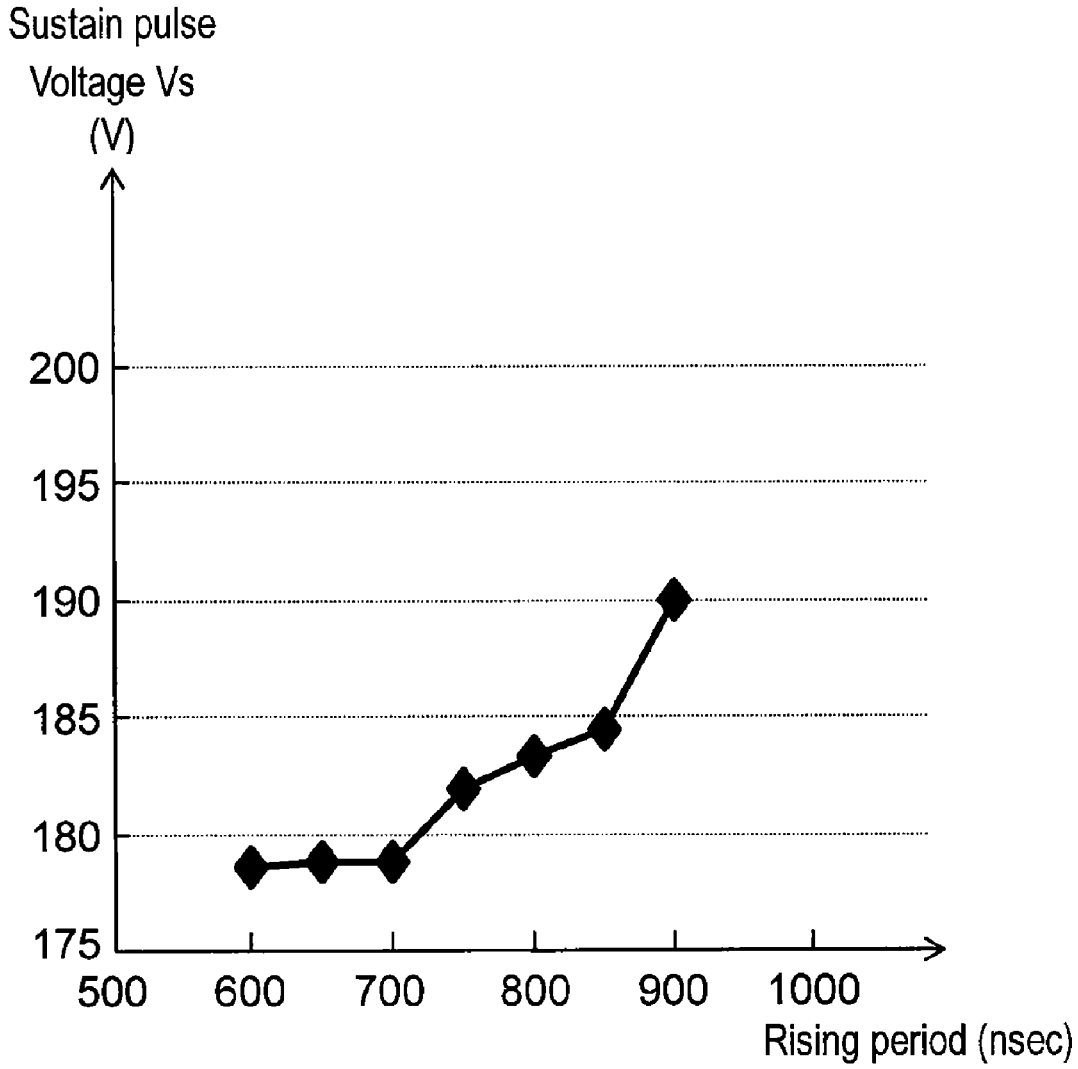
FIG. 13 is a characteristic diagram showing the relation between the "rising period" and sustain pulse voltage Vs.

FIG. 13 is a characteristic diagram showing the relation between the "rising period" and sustain pulse voltage Vs in accordance with the first exemplary embodiment of the present invention. In FIG. 13, the vertical axis shows the sustain pulse voltage Vs required for causing the stable sustain discharge, and the horizontal axis shows the length of the "rising period". In FIG. 13, similarly to FIG. 11 and FIG. 12, the resonance cycle of the electric power recovering circuit is set at 2000 nsec, the length of one cycle of the sustain pulses is set at 2.7 μsec, the "falling period" is set at 900 nsec, and the "rising period" is varied from 600 nsec to 900 nsec by 50 nsec.

According to FIG. 13, as the length of the "rising period", namely the operation period of the electric power recovering circuit, is increased, the value of sustain pulse voltage Vs required for causing the stable sustain discharge increases. As discussed above, that is because extending the "rising period" makes the intensity of the discharge caused in the discharge cell relatively weak, hence sufficient wall charge is not produced in the discharge cell, and the wall charge accumulated in the discharge cell decreases therefore.

In the present embodiment, the first sustain pulse serving as the reference is generated as a sustain pulse having the following feature.

In other words, the first sustain pulse occurs as a sustain pulse where the power recovery efficiency in the electric power recovering circuit can be increased to some extent and somewhat strong sustain discharge can be caused. Here, "the power recovery efficiency in the electric power recovering circuit can be increased to some extent" means that the power recovery efficiency can be made higher than that of the sustain pulse of steep rising that causes light emission having one peak in the discharge cells (FIG. 8) and the variation in timing of causing discharge between the discharge cells can be suppressed. The "somewhat strong sustain discharge" means that it is possible to cause stronger discharge than that of the sustain pulse of the gentle rising that has been used for measuring the characteristic in FIG. 10. Here, this gentle rising can increase the power recovery efficiency in the electric power recovering circuit and can cause light emission having one peak in the discharge cells.

In the present embodiment, as shown in FIG. 7A, the "rising period" of the first sustain pulse is set at the length between the sustain pulse of steep rising used for measuring the characteristic of FIG. 8 and the sustain pulse of the gentle rising used for measuring the characteristic of FIG. 10. Here, the length is set at about 800 nsec for resonance cycle 2000 nsec, for example.

The second sustain pulse of FIG. 7B is generated as a sustain pulse where the "rising period" is extended to a length at which light emission having one peak can be caused in the discharge cells, and the rising is sufficiently moderated. Here, the length is set at about 850 nsec for resonance cycle 2000 nsec, for example. Thus, the recovery efficiency in the electric power recovering circuit is improved and the variation in timing of causing discharge between the discharge cells can be suppressed.

The third sustain pulse of FIG. 7C is generated as the following sustain pulse. In this sustain pulse, the "rising period" is shortened to a length at which light emission having one peak can be caused in the discharge cells, and the rising is sufficiently sharpened. Here, the length is set at about 650 nsec for resonance cycle 2000 nsec, for example. Thus, the variation in timing of causing discharge between the discharge cells is suppressed, and strong discharge is caused to produce sufficient wall charge in the discharge cells.

In the present embodiment, the first sustain pulse, the second sustain pulse, and the third sustain pulse are switched and generated so that the second sustain pulse does not continue. Thus, the power consumption is reduced and sustain discharge is stabilized.

Figure 14:
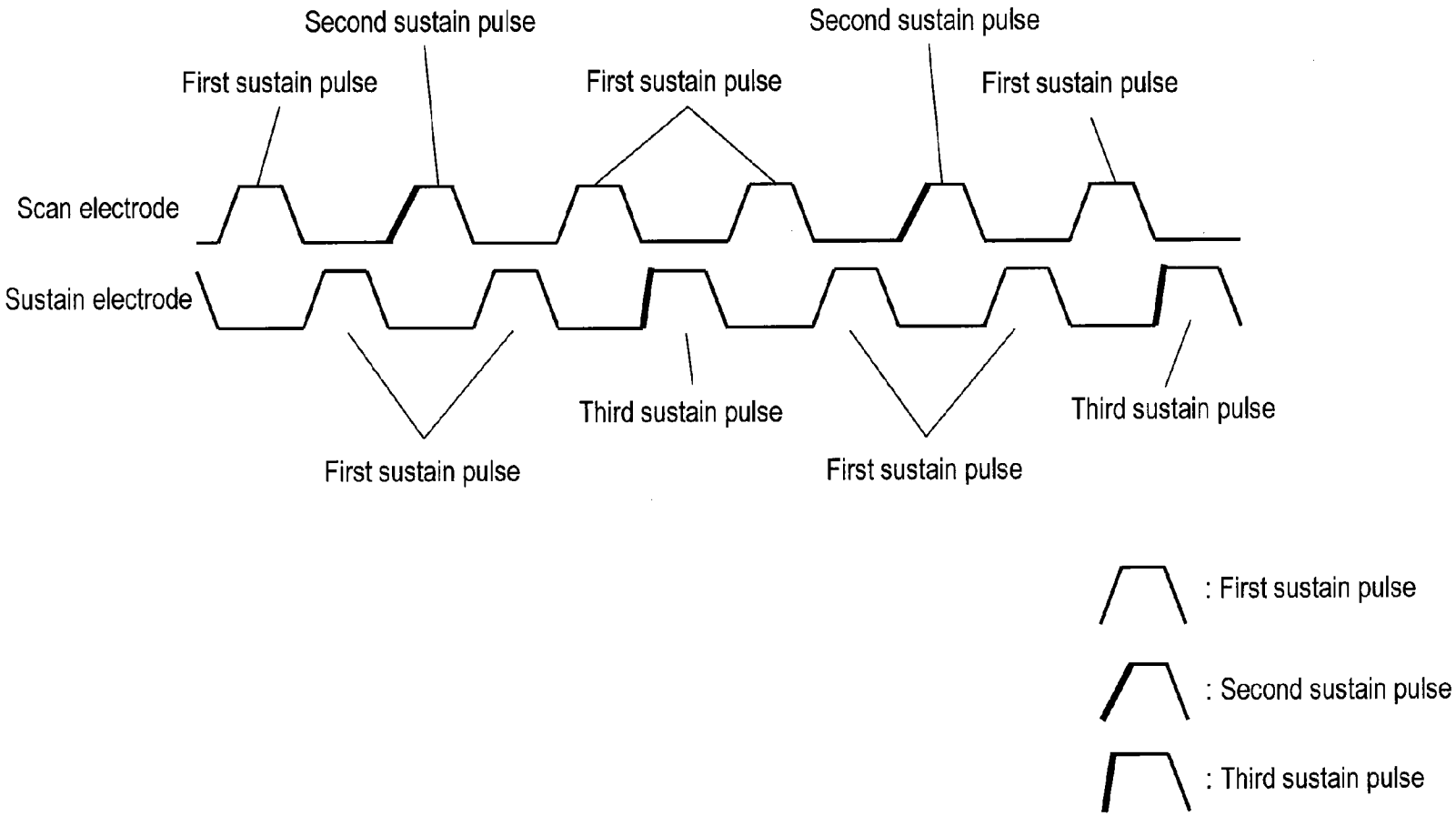
FIG. 14 is a schematic waveform chart showing an example of generation of three-kinds of sustain pulses in accordance with the first exemplary embodiment.

FIG. 14 is a schematic waveform chart showing an example of generation of three-kinds of sustain pulses in accordance with the first exemplary embodiment of the present invention.

In the present embodiment, as shown in FIG. 14, each of the second sustain pulse and the third sustain pulse is generated once in every six sustain pulse generations, and the first sustain pulse is generated in the remaining four of the six sustain pulse generations. In other words, the first sustain pulse, the second sustain pulse, and the third sustain pulse are switched and generated in the following order: the second sustain pulse is generated, then the first sustain pulse is generated twice, then the third sustain pulse is generated, then the first sustain pulse is generated twice, then the second sustain pulse is generated again. This order is employed for the following reason.

In the first sustain pulse as the reference, the power recovery efficiency can be made higher than that of the third sustain pulse, and the wall charge accumulated in the discharge cells can be made more than the discharge by the second sustain pulse. While, the length of the "rising period" is set to be between the lengths of the "rising period" of the second sustain pulse and the "rising period" of the third sustain pulse, so that light emission having two peaks is apt to occur in the discharge cells and variation in discharge is apt to increase, as shown in FIG. 9.

In the present embodiment, however, one of three caused sustain discharges is sustain discharge for causing light emission having one peak in the discharge cells using the second sustain pulse and the third sustain pulse. Thus, discharge variation that can be caused by the first sustain pulse can be suppressed, and the variation in luminance between the discharge cells can be reduced to achieve stable light emission.

Next, the rising of the second sustain pulse is set to be gentler than that of the other sustain pulses by making the "rising period" longer, so that the recovery efficiency of the electric power recovering circuit can be improved and the reduction effect of the power consumption can be improved. In addition, light emission having one peak can be caused in the discharge cells, so that the variation in timing of causing discharge between the discharge cells can be suppressed. However, the rising is gentler than that of the other sustain pulses. Therefore, the caused discharge becomes weak, and only small amount of wall charge can be produced in the discharge cells.

In the present embodiment, however, the second sustain pulse does not occur continuously, and five of six caused sustain discharges are caused by the first sustain pulse capable of causing discharge stronger than that by the second sustain pulse, and the third sustain pulse capable of causing further stronger discharge. Thus, sufficient wall charge can be accumulated in the discharge cells, and stable sustain discharge can be caused continuously.

In the third sustain pulse, the "rising period" is set to be shorter than that of the other sustain pulses, and the rising is set to be steeper. Therefore, sufficient wall charge can be produced in the discharge cells by strong discharge, and the variation in timing of causing discharge between the discharge cells can be suppressed by causing light emission having one peak in the discharge cells. While, the period when the electric power recovering circuit is operated is shorter than that of the other sustain pulses, and hence the power recovery efficiency reduces.

In the present embodiment, however, five of six caused sustain discharges are caused by the first sustain pulse of high power recovery efficiency and the second sustain pulse of higher power recovery efficiency. Thus, the power recovery efficiency is comprehensively improved, and the power consumption can be reduced.

Thus, in the present embodiment, three kinds of sustain pulses are switched and generated so that the second sustain pulse does not continue. The three kinds of sustain pulses include the first sustain pulse serving as the reference, the second sustain pulse whose rising is gentler than that of the first sustain pulse, and the third sustain pulse whose rising is steeper than that of the first sustain pulse. Thus, even in the panel whose screen size, luminance, and definition are increased, sustain discharge can be stably caused while the power consumption is reduced, and the image display quality can be improved.

In the present embodiment, the "rising periods" of the first sustain pulse, the second sustain pulse, and the third sustain pulse are set at 800 nsec, 850 nsec, and 650 nsec for resonance cycle 2000 nsec, respectively. However, the present embodiment is not limited to these numerical values. The relation between each of the above-mentioned effects and the length of the "rising period" depends on the resonance cycle, so that it is preferable to optimally set the length of the "rising period" in response to the resonance cycle. In order to obtain the effects, preferably, the three-kinds of sustain pulses are generated on the following conditions. The first sustain pulse is generated while the "rising period" is set at 80% or higher and lower than 85% of a half the resonance cycle. The second sustain pulse is generated while the "rising period" is set at 85% or higher and 100% or lower of a half the resonance cycle. The third sustain pulse is generated while the "rising period" is set at 65% or higher and lower than 80% of a half the resonance cycle. The "rising periods" of the first sustain pulse, the second sustain pulse, and the third sustain pulse are set different from each other by 50 nsec or longer.

Figure 15:
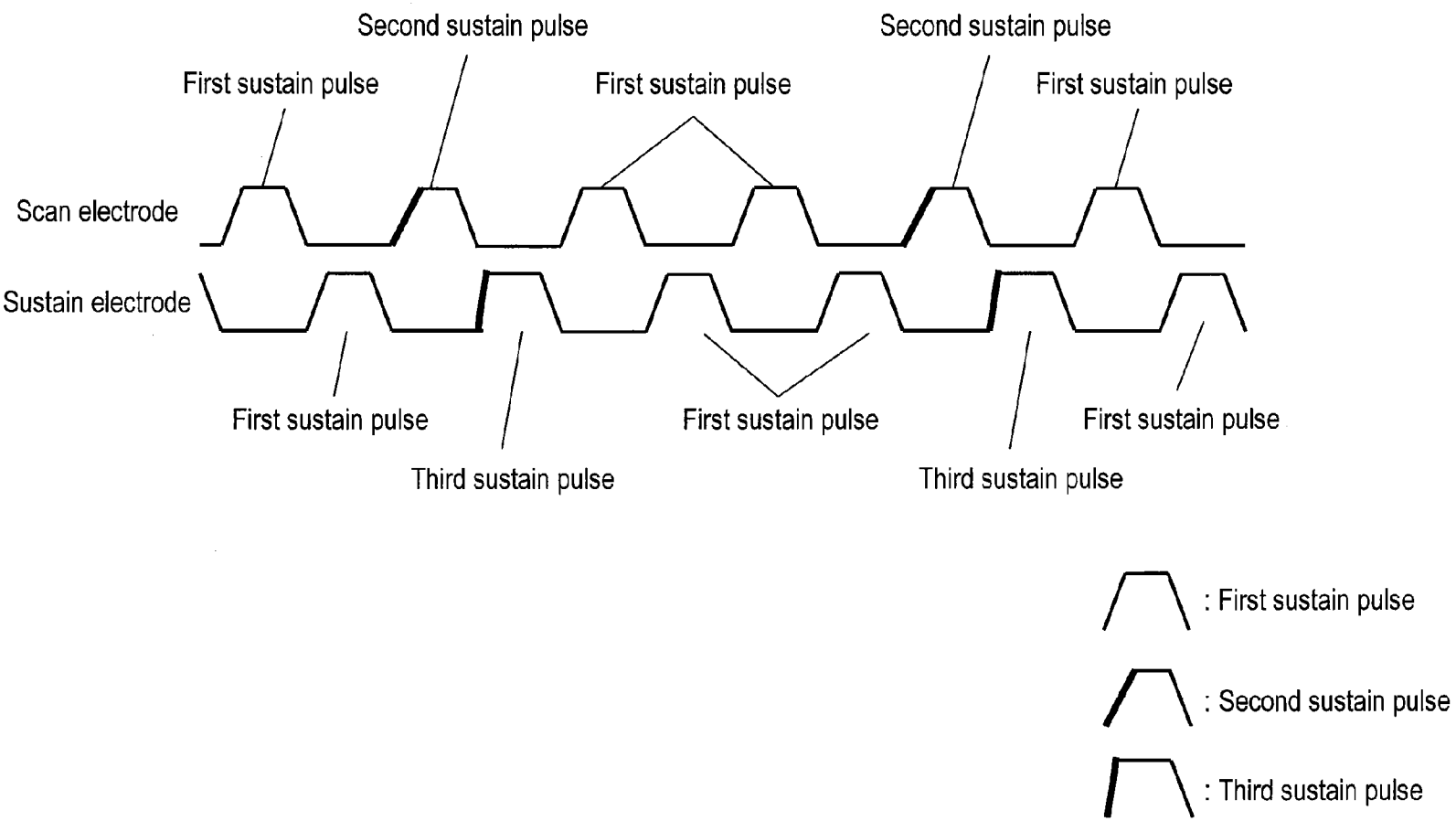
FIG. 15 is a schematic waveform chart showing another example of generation of three-kinds of sustain pulses in accordance with the first exemplary embodiment.

The generation frequency and generation order of the sustain pulses are not limited to the above-mentioned frequency and order. FIG. 15 is a schematic waveform chart showing another example of generation of three-kinds of sustain pulses in accordance with the first exemplary embodiment. For example, as shown in FIG. 15, the third sustain pulse may be generated immediately after the second sustain pulse. In this structure, stronger sustain discharge can be caused by the third sustain pulse immediately after relatively weak sustain discharge by the second sustain pulse, so that the discharge can be caused further stably.

Second Exemplary Embodiment

In the first exemplary embodiment, the first sustain pulse, the second sustain pulse, and the third sustain pulse are switched and generated, thereby producing effects of reducing the discharge variation and reducing the power consumption. However, these effects depend on the rate of discharge cells to be lighted (lit cell), namely light-emitting rate.

This is for the following reason. The output impedance of the electric power recovering circuit is larger than that of the clamping circuit, so that the waveform of the "rising period" varies when the light-emitting rate of the discharge cells varies dependently on the display image and the load during driving varies.

Therefore, the following method may be employed during the driving. The all-cell light-emitting rate showing the ratio of the lit cells to all discharge cells of panel 10 is detected, the numbers of generations of the second sustain pulse and the third sustain pulse are varied in response to the detection result, and the generation frequencies of the second sustain pulse and the third sustain pulse are varied. For example, in a subfield of low all-cell light-emitting rate, it is considered that the driving load is relatively small and the variation in waveform is relatively small, so that the number of generations of the second sustain pulse is increased to increase the generation frequency of the second sustain pulse. In a subfield of high light-emitting rate, it is considered that the driving load is relatively large and the waveform is relatively apt to vary, so that the number of generations of the third sustain pulse is increased to increase the generation frequency of the third sustain pulse.

Thus, the above-mentioned effects can be further improved by varying the number of generations of each sustain pulse in response to the detected all-cell light-emitting rate.

Even when the all-cell light-emitting rate is constant, the number of lit cells occurring on one display electrode pair 24 significantly varies and the driving load of each display electrode pair 24 also varies in response to the pattern of an image to be displayed, namely in response to distribution of the lit cells.

Figure 16:
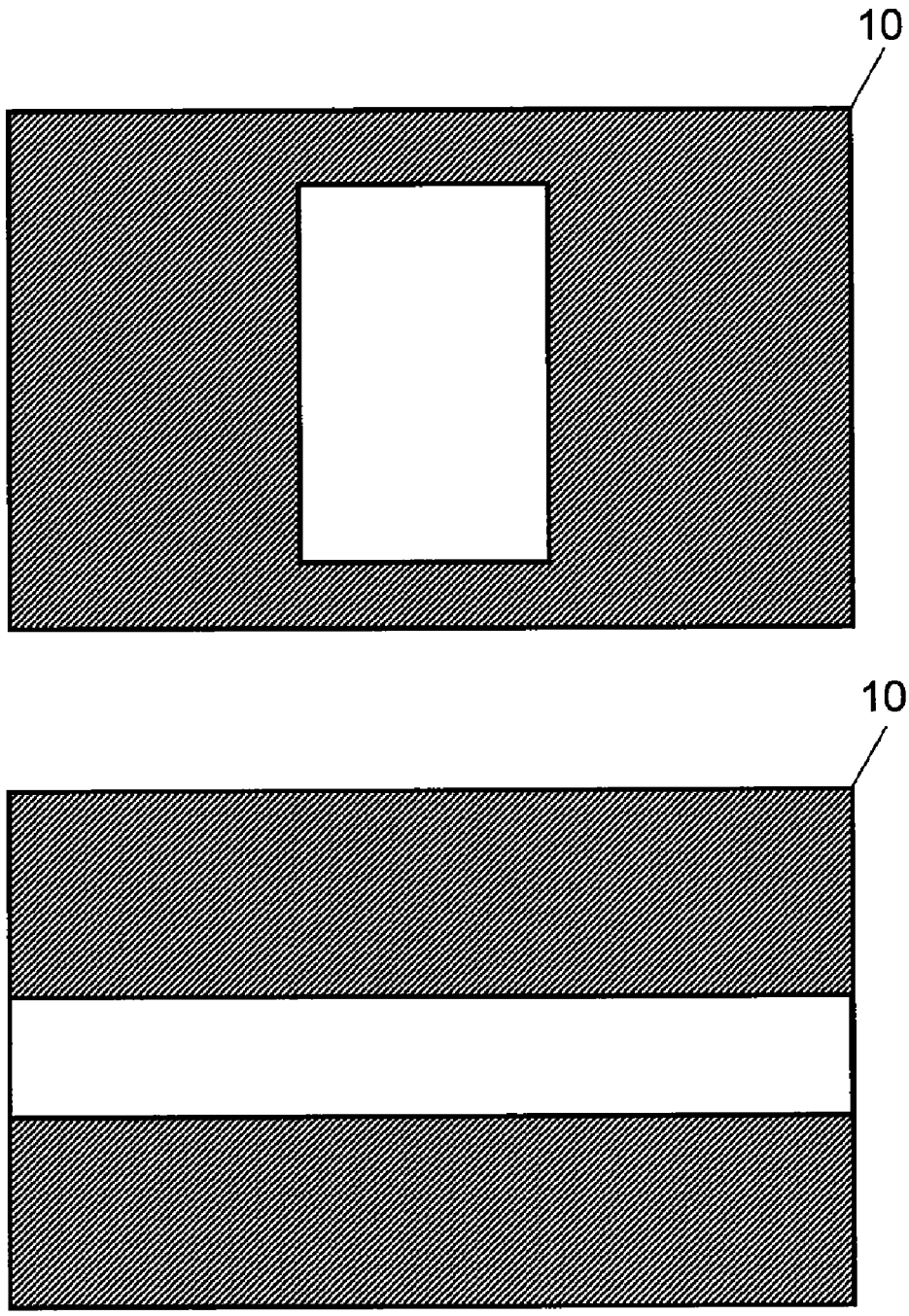
FIG. 16 is a schematic diagram for illustrating patterns where all-cell light-emitting rates are equal and the distributions of lit cells are different.

FIG. 16 is a schematic diagram for illustrating patterns where the all-cell light-emitting rate is constant and the distributions of lit cells are different. In FIG. 16, display electrode pairs 24 are arranged while extending in the lateral direction on the drawing similarly to FIG. 2. In FIG. 16, the oblique line parts show the distribution of the unlit cells where sustain discharge is not caused, and the white parts having no oblique line show the distribution of the lit cells.

For example, when the lit cells are distributed in the longitudinally extending shape (in the drawing) as shown in the upper part of FIG. 16, the number of lit cells occurring on one display electrode pair is relatively small, and the driving load of the display electrode pair is also small. When the lit cells are distributed in the laterally extending shape (in the drawing) as shown in the lower part of FIG. 16 though the all-cell light-emitting rate is constant, however, the number of lit cells occurring on one display electrode pair increases, and the driving load of one display electrode pair increases.

Thus, even when the all-cell light-emitting rate is constant, the driving load partially varies in response to the pattern, and a display electrode pair where driving load is large can occur partially dependently on the pattern.

In the present embodiment, the following configuration may be employed. The all-cell light-emitting rate is detected, the light-emitting rate in each of a plurality of regions that are obtained by dividing the display region of the panel is also detected as a partial light-emitting rate, and the occurrence rate of each sustain pulse is varied in response to these detection results.

Figure 17:
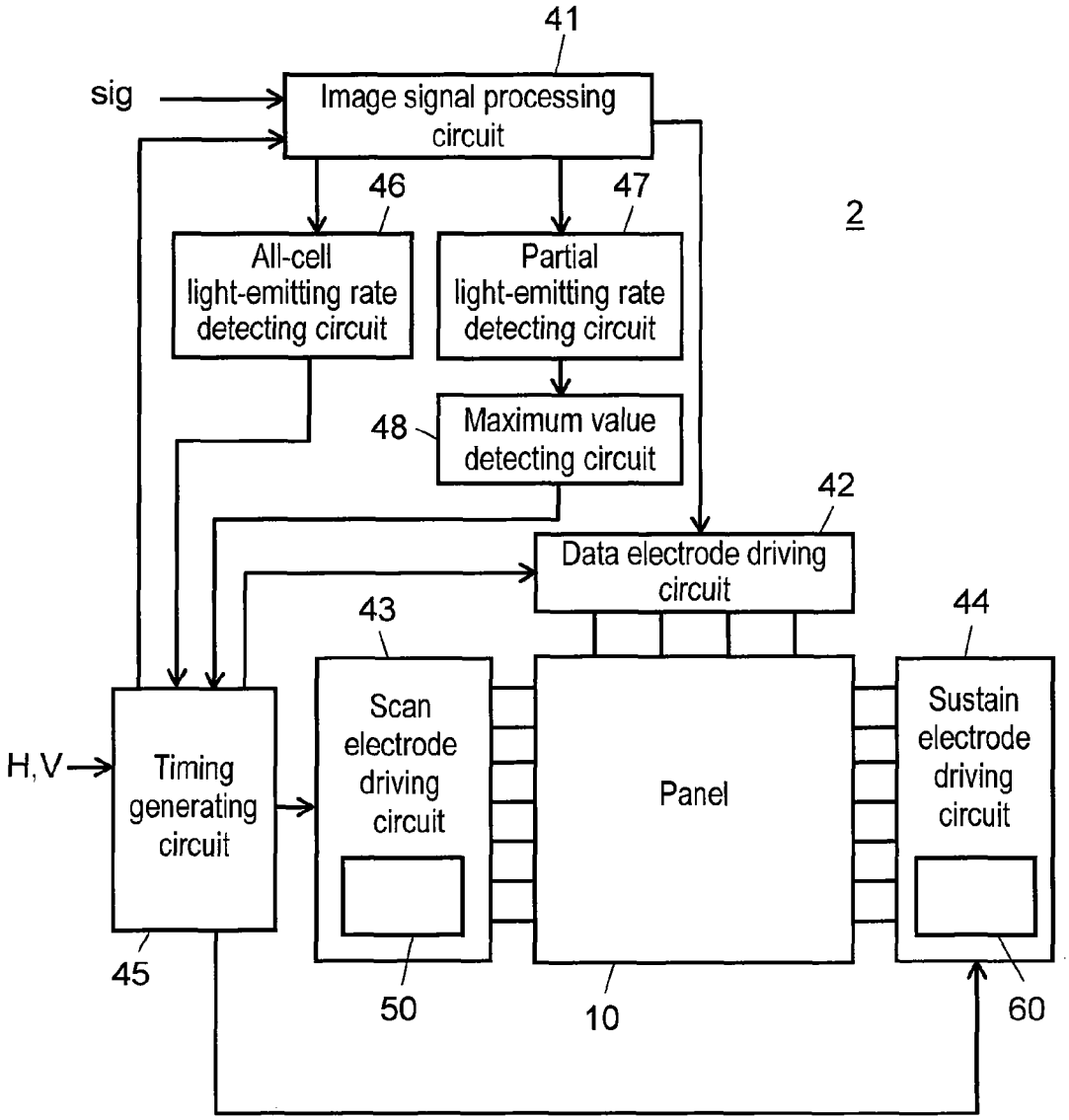
FIG. 17 is a circuit block diagram showing an example of circuitry of a plasma display device in accordance with a second exemplary embodiment of the present invention.

FIG. 17 is a circuit block diagram showing an example of circuitry of a plasma display device in accordance with a second exemplary embodiment of the present invention. Plasma display device 2 has the following elements:

panel 10;
image signal processing circuit 41;
data electrode driving circuit 42;
scan electrode driving circuit 43;
sustain electrode driving circuit 44;
timing generating circuit 45;
all-cell light-emitting rate detecting circuit 46;
partial light-emitting rate detecting circuit 47;
maximum value detecting circuit 48; and
a power supply circuit (not shown) for supplying power required for each circuit block.

The circuit blocks having a configuration and operation similar to those in FIG. 4 of the first exemplary embodiment are denoted with the same reference marks, and hence the descriptions of the circuit blocks are omitted.

All-cell light-emitting rate detecting circuit 46, based on the image data of each subfield, detects the ratio of the number of discharge cells to be lighted to the number of all discharge cells, namely the all-cell light-emitting rate, in each subfield. All-cell light-emitting rate detecting circuit 46 compares the detected all-cell light-emitting rate with a predetermined light-emitting rate threshold (for example, 50%), and outputs a signal showing the comparison result to timing generating circuit 45.

Partial light-emitting rate detecting circuit 47 divides the display region of the panel into a plurality of regions, and detects, based on the image data of each subfield, the ratio of the number of discharge cells to be lighted to the number of discharge cells, namely the partial light-emitting rate, in each region and subfield.

Figure 18:
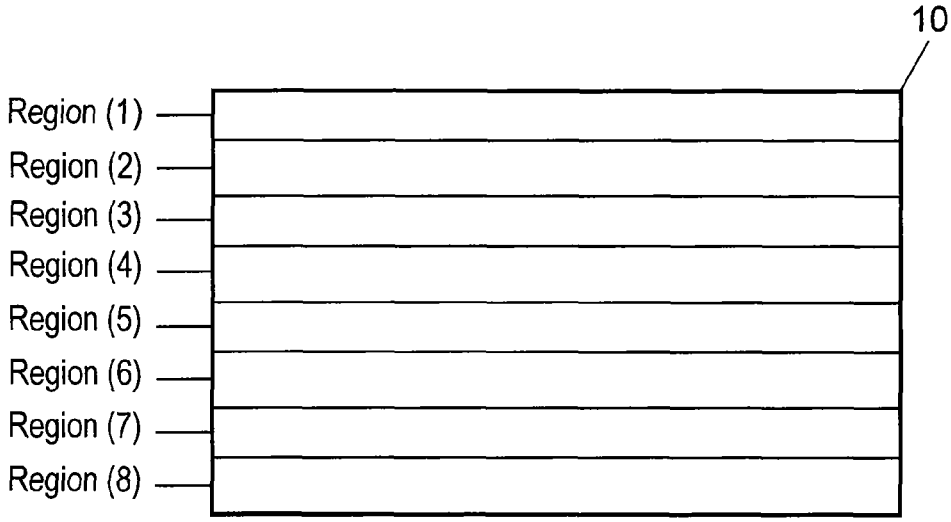
FIG. 18 is a schematic diagram showing an example of the region where partial light-emitting rate is detected in accordance with the second exemplary embodiment.

FIG. 18 is a schematic diagram showing an example of the region where partial light-emitting rate is detected in accordance with the second exemplary embodiment. In the present embodiment, as shown in FIG. 18, the display region of panel 10 is disposed so that its boundary is parallel with display electrode pairs 24, and is divided into eight regions (region (1) through region (8) in FIG. 18) so that the numbers of display electrode pairs in respective regions are as uniform as possible. The light-emitting rate of each region is detected as the partial light-emitting rate. For example, in the panel where the number of display electrode pairs is 1080, the display region is divided into regions each of which has 135 display electrode pairs, and the light-emitting rate of each region is detected. Thus, eight partial light-emitting rates can be detected in each subfield.

Maximum value detecting circuit 48 compares the partial light-emitting rates detected by partial light-emitting rate detecting circuit 47 with each other, and detects the maximum value in each subfield. Maximum value detecting circuit 48 then compares the detected maximum value with a predetermined maximum value threshold (for example, 60%), and outputs a signal showing the comparison result to timing generating circuit 45.

Timing generating circuit 45 generates various timing signals for controlling operations of respective circuit blocks based on horizontal synchronizing signal H, vertical synchronizing signal V, and the outputs from all-cell light-emitting rate detecting circuit 46 and maximum value detecting circuit 48, and supplies them to respective circuit blocks. Timing generating circuit 45 varies the number of generations of each of the sustain pulses based on the outputs from all-cell light-emitting rate detecting circuit 46 and maximum value detecting circuit 48, and outputs a timing signal responsive to it to scan electrode driving circuit 43 and sustain electrode driving circuit 44.

Plasma display device 2 having such a configuration can change the number of generations of each sustain pulse in response to the all-cell light-emitting rate and the maximum value of the partial light-emitting rates. For example, the following driving may be employed. In a subfield where both the all-cell light-emitting rate and the maximum value of the partial light-emitting rates are smaller than the set thresholds, it is considered that the driving load is relatively small and the variation in waveform is relatively small, so that the number of generations of the second sustain pulse can be increased to increase the generation frequency of the second sustain pulse. In a subfield where both the all-cell light-emitting rate and the maximum value of the partial light-emitting rates are the thresholds or larger, it is considered that the driving load is relatively large and the waveform is relatively apt to vary, so that the number of generations of the third sustain pulse can be increased to increase the generation frequency of the third sustain pulse. A specific example of this control is described.

FIG. 19 is a diagram showing an example of generation of each sustain pulse corresponding to the all-cell light-emitting rate and the maximum value of the partial light-emitting rates in accordance with the second exemplary embodiment.

For example, as shown in FIG. 19, in the subfield where both the all-cell light-emitting rate and the maximum value of the partial light-emitting rates are smaller than the threshold, the second sustain pulse is generated once in every three sustain pulse generations, the third sustain pulse is generated once in every six sustain pulse generations, and the first sustain pulse is generated in the remaining sustain pulse generations. In the subfield where both the all-cell light-emitting rate and the maximum value of the partial light-emitting rates are the threshold or larger, the second sustain pulse is generated once in every six sustain pulse generations, the third sustain pulse is generated once in every three sustain pulse generations, and the first sustain pulse is generated in the remaining sustain pulse generations. In the subfield where the all-cell light-emitting rate is a light-emitting rate threshold or larger and the maximum value of the partial light-emitting rates is smaller than a maximum value threshold, the second sustain pulse is generated once in every four sustain pulse generations, the third sustain pulse is generated once in every five sustain pulse generations, and the first sustain pulse is generated in the remaining sustain pulse generations. In the subfield where the all-cell light-emitting rate is smaller than the light-emitting rate threshold and the maximum value of the partial light-emitting rates is the maximum value threshold or larger, the second sustain pulse is generated once in every five sustain pulse generations, the third sustain pulse is generated once in every four sustain pulse generations, and the first sustain pulse is generated in the remaining sustain pulse generations.

Thus, by detecting the all-cell light-emitting rate and the maximum value of the partial light-emitting rates and changing the number of generations of each sustain pulse in response to these detection results, control corresponding to the pattern of the display image can be achieved and the effect of reducing the power consumption and the effect of stably causing the sustain discharge can be further improved.

As discussed above, in the present embodiment, the all-cell light-emitting rate, the partial light-emitting rates, and the maximum value of the partial light-emitting rates are detected, and the generations of each sustain pulse in response to the detection results can be controlled. Therefore, control responsive to the display image can be performed more finely, and the effect of stably causing the sustain discharge while reducing the power consumption can be further improved.

The light-emitting rate threshold is set at 50% and the maximum value threshold is set at 60% in the present embodiment; however, the present invention is not these numerical values. Preferably, these thresholds are set at the optimum values based on the characteristic of the panel and the specification of the plasma display device. Alternatively, a plurality of values may be set as each of the light-emitting rate threshold and the maximum value threshold, and the change or the like of the number of generations of each sustain pulse may be performed more finely.

In the present embodiment, the display region of panel 10 is divided into eight regions. However, this value is simply one example. This value is required to be set at the optimum value in response to the characteristic of the panel and the specification of the plasma display device. For example, the region may be divided in response to the specification of the integrated circuit (IC) used for driving the display electrode pair. As one specific example, in the plasma display device configured so as to drive 108 scan electrodes or sustain electrodes with one IC, 108 display electrode pairs may be set as one region in response to the IC, and the panel of 1080 display electrode pairs may be divided into 10 regions. Alternatively, the number of display electrode pairs may be set to be the same as the number of regions, and the light-emitting rate may be detected for each display electrode pair.

The present embodiment of the present invention is effective also in a panel of an electrode structure where a scan electrode is adjacent to another scan electrode and a sustain electrode is adjacent to another sustain electrode, namely an electrode structure where the arrangement of the electrodes disposed on front plate 21 is "—scan electrode, scan electrode, sustain electrode, sustain electrode, scan electrode, scan electrode,—" (hereinafter referred to as "ABBA electrode structure").

In the panel having the ABBA electrode structure, the variation in sustain pulse voltage between adjacent discharge cells can be in the same phase, and hence the reactive power can be reduced. In the discharge cells in the ABBA electrode structure, however, discharge is apt to vary. This is for the following reason. The same kind of electrodes are adjacent to each other (scan electrode—scan electrode, or sustain electrode—sustain electrode) in the ABBA electrode structure, so that the applied sustain pulses are in the same phase, and hence the reactive power can be reduced. However, the electric field applied between the discharge cells adjacent to each other in the row direction in this electrode structure is smaller than that between the discharge cells in a usual electrode structure where scan electrodes are arranged alternately (hereinafter referred to as "ABAB electrode structure"). Therefore, in the ABBA electrode structure, the charge easily moves to the discharge cells adjacent to each other in the column direction to increase the amount of the charge moving between the discharge cells, and hence the variation in wall charge increases. In the embodiment of the present invention, the power consumption can be reduced and stable sustain discharge can be caused even in a panel where discharge is apt to vary.

Numerical values shown in the embodiment of the present invention, for example, specific numerical values of "rising period", resonance cycle, light-emitting rate threshold, and maximum value threshold, are set based on the characteristic of a 42-inch panel having 1080 display electrode pairs. These numerical values are simply one example in the embodiment. The present invention is not limited to these numerical values. Preferably, these numerical values are set optimally based on the characteristic of the panel and the specification of the plasma display device. These numerical values are allowed to vary within the range capable of producing the above-mentioned effects.

The embodiment of the present invention can be applied to a panel driving method by the so-called two-phase driving, and the effects similar to the above-mentioned effects can be obtained. The two-phase driving is described below. Scan electrode SC1 through scan electrode SCn are divided into first and second scan electrode groups. The address period consists of a first address period when scan pulses are sequentially applied to scan electrodes belonging to the first scan electrode group, and a second address period when scan pulses are sequentially applied to scan electrodes belonging to the second scan electrode group. In at least one of the first address period and second address period, scan pulses that change from a second voltage, which is higher than the scan pulse voltage, to the scan pulse voltage and change to the second voltage again are sequentially applied to scan electrodes that belong to the scan electrode group to be applied with the scan pulses. One of a third voltage higher than the scan pulse voltage and a fourth voltage higher than the second voltage and the third voltage is applied to the scan electrodes belonging to the scan electrode group to which the scan pulses are not applied. While the scan pulse voltage is applied to at least adjacent scan electrodes, the third voltage is applied.

In the embodiment of the present invention, the erasing ramp voltage is applied to scan electrode SC1 through scan electrode SCn. However, the erasing ramp voltage may be applied to sustain electrode SU1 through sustain electrode SUn. Alternatively, erasing discharge may be caused by not the erasing ramp voltage but the so-called narrow-width erasing pulse.

In the embodiment of the present invention, electric power recovering circuits 51 and 61 use one inductor commonly in rising and falling of the sustain pulse. However, electric power recovering circuits 51 and 61 may use a plurality of inductors and use different inductors in rising and falling of the sustain pulse.

INDUSTRIAL APPLICABILITY

In the present invention, even in the panel whose screen size, luminance, and definition are increased, sustain discharge can be stably caused while the power consumption is reduced, and the image display quality can be improved. Therefore, the present invention is useful as a plasma display device and a driving method for the panel.

The invention claimed is:

1. A plasma display device comprising:

a plasma display panel that is driven by a subfield method and has a plurality of discharge cells, each of the discharge cells having a display electrode pair that includes a scan electrode and a sustain electrode, wherein the subfield method includes:

setting a plurality of subfields in one field;

setting a luminance weight for each of the subfields; and performing gradation display, each of the subfields having an initializing period, an address period, and a sustain period;

an electric power recovering circuit for raising or falling a sustain pulse by resonating an inductor and an inter-electrode capacity of the display electrode pair;

a clamping circuit for clamping the sustain pulse on a predetermined voltage; and a sustain pulse generating circuit for alternately applying a number of sustain pulses to the display electrode pairs in the sustain period, where the number is proportional to the luminance weights, wherein the sustain pulse generating circuit generates at least three kinds of sustain pulses that include a first sustain pulse serving as a reference with a first rising period, a second sustain pulse with a second rising period where the second rising period is longer than the first rising period, and a third sustain pulse with a third rising period, where the third rising period is shorter than the first rising period, wherein the first sustain pulse, the second sustain pulse, and the third sustain pulse are switched and generated within a period so that the second sustain pulse follows at least one of the first sustain pulse and the third sustain pulse, the third sustain pulse follows the first sustain pulse, and at least one first sustain pulse follows an other first sustain pulse.

2. The plasma display device of claim 1, wherein the sustain pulse generating circuit generates the third sustain pulse immediately after generation of the second sustain pulse.

3. The plasma display device of claim 1, wherein the sustain pulse generating circuit generates the first sustain pulse where rising period is set at 80% or higher and lower than 85% of a half a resonance cycle of the inter-electrode capacity and the inductor, generates the second sustain pulse where rising period is set at 85% or higher and 100% or lower of a half the resonance cycle, and generates the third sustain pulse where rising period is set at 65% or higher and lower than 80% of a half the resonance cycle, and each sustain pulse is generated while the rising period of the first sustain pulse, the rising period of the second sustain pulse, and the rising period of the third sustain pulse are made different from each other by 50 nsec or longer.

4. The plasma display device of claim 1, further comprising:

an all-cell light-emitting rate detecting circuit for detecting a ratio of the discharge cells to be lighted to all discharge cells in a display region of the plasma display panel in each subfield, as an all-cell light-emitting rate, wherein the sustain pulse generating circuit changes the number of generations of the second sustain pulse and the number of generations of the third sustain pulse in response to a detection result in the all-cell light-emitting rate detecting circuit.

5. The plasma display device of claim 4, further comprising:

a partial light-emitting rate detecting circuit for dividing the display region of the plasma display panel into a plurality of regions having a boundary parallel to the display electrode pair, and detecting a ratio of the discharge cells to be lighted to the discharge cells in each region, as a partial light-emitting rate, in each region and each subfield; and a maximum value detecting circuit for detecting a maximum value of the partial light-emitting rates in the display region in each subfield, wherein the sustain pulse generating circuit changes the number of generations of the second sustain pulse and the number of generations of the third sustain pulse in response to the all-cell light-emitting rate and the maximum value output from the maximum value detecting circuit.

6. A driving method for a plasma display panel, the plasma display panel having a plurality of discharge cells, each of the discharge cells having a display electrode pair that includes a scan electrode and a sustain electrode, the driving method comprising:

setting a plurality of subfields in one field;

setting a luminance weight for each of the subfields, each of the subfields having an initializing period, an address period, and a sustain period; and generating as many sustain pulses as the number corresponding to the luminance weight in the sustain period using an electric power recovering circuit and a clamping circuit, and alternately applying the sustain pulses to the display electrode pairs, and driving the display electrode pairs, wherein the electric power recovering circuit raises or falls the sustain pulses by resonating an inductor and an inter-electrode capacity of the display electrode pair, and the clamping circuit clamps the sustain pulse on a predetermined voltage, wherein at least three kinds of sustain pulses that include a first sustain pulse serving as a reference with a first rising period, a second sustain pulse with a second rising period where the second rising period is longer than the first rising period, and a third sustain pulse with a third rising period, where the third rising period is shorter than the first rising period, wherein the first sustain pulse, the second sustain pulse, and the third sustain pulse are switched and generated within a period so that the second sustain pulse follows at least one of the first sustain pulse and the third sustain pulse, the third sustain pulse follows the first sustain pulse, and at least one first sustain pulse follows an other first sustain pulse.

7. The driving method for the plasma display panel of claim 6, wherein ratio of the discharge cells to be lighted to all discharge cells in a display region of the plasma display panel is detected as an all-cell light-emitting rate in each subfield, and the number of generations of the second sustain pulse and the number of generations of the third sustain pulse are varied in response to the detected all-cell light-emitting rate.

8. The driving method for the plasma display panel of claim 7, wherein the display region of the plasma display panel is divided into a plurality of regions having a boundary parallel to the display electrode pair, ratio of the discharge cells to be lighted to the discharge cells in each region is detected as a partial light-emitting rate in each region and each subfield, a maximum value of the partial light-emitting rates in the display region is detected in each subfield, and the number of generations of the second sustain pulse and the number of generations of the third sustain pulse are changed in response to the all-cell light-emitting rate and the maximum value of the partial light-emitting rates.

* * * * *